US008569688B2

(12) United States Patent
Sideris

(10) Patent No.: US 8,569,688 B2
(45) Date of Patent: Oct. 29, 2013

(54) MASS SPECTROMETER AND METHODS OF MASS SPECTROMETRY

(76) Inventor: Dimitrios Sideris, Richmond (GB)

( * ) Notice: Subject to any disclaimer, the term of this patent is extended or adjusted under 35 U.S.C. 154(b) by 28 days.

(21) Appl. No.: 13/382,908

(22) PCT Filed: Jul. 6, 2010

(86) PCT No.: PCT/GB2010/001296

§ 371 (c)(1),
(2), (4) Date: Mar. 23, 2012

(87) PCT Pub. No.: WO2011/004149

PCT Pub. Date: Jan. 13, 2011

(65) Prior Publication Data

US 2012/0181422 A1 Jul. 19, 2012

(30) Foreign Application Priority Data

Jul. 8, 2009 (GB) ..... 0911884.5

(51) Int. Cl.
*H01J 49/26* (2006.01)

(52) U.S. Cl.
USPC ..... 250/282

(58) Field of Classification Search
USPC ..... 250/281–300
See application file for complete search history.

(56) References Cited

U.S. PATENT DOCUMENTS 5,565,105 A 10/1996 Thakor
6,893,878 B2 * 5/2005 Sideris ..... 436/177

(Continued)

FOREIGN PATENT DOCUMENTS

GB 1 488 244 10/1977
GB 2 421 632 6/2006

(Continued)

OTHER PUBLICATIONS

XP-002606236, A Small Isochronous Storage Ring for Spectrometry, by O. S. Kozlov and S. I. Kozlov, Laboratory of High Energies, Joint Institute for Nuclear Research, pp. 451-156, 2001.

(Continued)

*Primary Examiner* — Jack Berman
*Assistant Examiner* — Eliza Osenbaugh-Stewart
(74) *Attorney, Agent, or Firm* — James P. Muraff; Neal, Gerber & Eisenberg LLP

(57) ABSTRACT

A mass spectrometer is disclosed, comprising: a chamber; an injection device adapted to inject charged particles into the chamber; and field generating apparatus. The field generating apparatus is adapted to establish at least one field acting on the charged particles, the at least one field having an angular trapping component configured to form at least one channel between a rotation axis and the periphery of the chamber, the at least one channel being defined by energy minima of the angular trapping component, the field generating apparatus being further adapted to rotate the angular trapping component about the rotation axis, whereby in use charged particles are angularly constrained along the at least one channel by the angular trapping component to rotate therewith, a centrifugal force thereby acting on the charged particles. The at least one field additionally has a radial balancing component having a magnitude increasing monotonically with increasing radius from the rotation axis, at least in the vicinity of the at least one channel, whereby in use charged particles move along the at least one channel under the combined influence of the centrifugal force and the radial balancing component to form one or more particle orbits according to the charge to mass ratios of the particles. The mass spectrometer further includes a detector configured to detect at least one of the particle orbits. Methods of mass spectrometry are also disclosed.

31 Claims, 21 Drawing Sheets

(56) References Cited

U.S. PATENT DOCUMENTS

| | | | | |
|---|---|---|---|---|
| 7,858,930 | B2 * | 12/2010 | Kaiser et al. | 250/282 |
| 2012/0256082 | A1 * | 10/2012 | Masujima et al. | 250/282 |

FOREIGN PATENT DOCUMENTS

| | | | |
|---|---|---|---|
| WO | 03051520 | | 6/2003 |
| WO | 2004086441 | A2 | 10/2004 |
| WO | 2004086441 | A3 | 10/2004 |
| WO | 2008132227 | A1 | 11/2008 |
| WO | 2011004149 | | 1/2011 |

OTHER PUBLICATIONS

XPO08128178, Cyclotrons as Mass Spectrometers, by David J. Clark, Lawrence Berkeley Laboratory, 1984 IEEE, pp. 534-539.
Search Report dated Nov. 19, 2009 for Great Britain Application No. GB0911884.5.
International Search Report and Written Opinion for PCT Application No. PCT/GB2010/001296 dated Nov. 18, 2010.
Response to Written Opinion for PCT Application No. PCT/GB2010/001296 dated May 5, 2011.
International Preliminary Report on Patentability for PCT Application No. PCT/GB2010/001296 dated Nov. 2, 2011.

* cited by examiner

MASS SPECTROMETER AND METHODS OF MASS SPECTROMETRY

This application is a national stage application claiming priority to PCT Application No. PCT/GB2010/001296 filed on Jul. 6, 2010, which claims priority to Great Britain Application No. 0911884.5 filed on Jul. 8, 2009. Both of which are hereby incorporated by reference in their entirety.

The present invention relates to mass spectrometers and methods of mass spectrometry for detecting charged particles according to their charge to mass ratio. The disclosed techniques have numerous applications including sorting of mixed particles, identification of particles, substance detection and substance purification.

Mass spectrometry is well known and involves manipulating charged particles by the use of electric and/or magnetic fields to obtain results derived from the particles' charge to mass (q/m) ratios. In one example, ionised molecules are accelerated using a charged plate into a region intersected by a perpendicular magnetic field. Due to the particles' motion, a Lorentz force arises on each particle such that its trajectory is curved. The degree of curvature will depend on the mass and charge of the molecule: heavier and/or lower charge particles being deflected less than lighter and/or higher charge ones. One or more detectors are arranged to receive the deflected particles and the distribution can be used to deduce information including the mass of each particle type and the relative proportion of the various particles. This can also be used to determine information such as the structure of the molecule and to identify the substance(s) under test. Specialist forms of mass spectrometer have been developed for particular applications.

Thus, mass spectrometry can be used for many purposes, including: identifying unknown compounds, determining isotopic compositions, investigating the structure of molecules, sorting samples of mixed particles, and quantifying the amount of a substance in a sample, amongst many others. Mass spectrometry can also be used to analyse virtually any type of particle which can be charged, including chemical elements and compounds, such as pharmaceuticals; biomolecules including proteins and their peptide constituents, DNA, RNA, enzymes etc.; and many other particulates including contaminants such as dust, etc.

In a related field, a centrifugal spectrometer has been used previously in WO-A-03/051520 to separate a sample of charged particles according to their charge to mass ratio under the influence of a shaped electric field. The particles to be separated are placed in a cavity filled with buffer solution, which is rotated at high speed. Various means are disclosed for applying a radial electric field of appropriate shape, and the particles separate along the cavity under the influence of the electric and centrifugal forces, enabling the isolation of individual particle types and relative measurements to be made. U.S. Pat. No. 5,565,105, WO-A-2008/132227, GB-A-1488244 and WO-A-2004/086441 disclose other particle separation devices.

In accordance with the present invention, a mass spectrometer is provided comprising a chamber, an injection device adapted to inject charged particles into the chamber, field generating apparatus adapted to establish at least one field acting on the charged particles, the at least one field having an angular trapping component configured to form at least one channel between a rotation axis and the periphery of the chamber, the at least one channel being defined by energy minima of the angular trapping component, the field generating apparatus being further adapted to rotate the angular trapping component about the rotation axis, whereby in use charged particles are angularly constrained along the at least one channel by the angular trapping component to rotate therewith, a centrifugal force thereby acting on the charged particles; and a radial balancing component having a magnitude increasing monotonically with increasing radius from the rotation axis, at least in the vicinity of the at least one channel, whereby in use charged particles move along the at least one channel under the combined influence of the centrifugal force and the radial balancing component to form one or more particle orbits according to the charge to mass ratios of the particles; and a detector configured to detect at least one of the particle orbits.

The invention also provides a method of mass spectrometry, comprising: injecting charged particles into a chamber; establishing at least one field acting on the charged particles, the at least one field having: an angular trapping component configured to form at least one channel between a rotation axis and the periphery of the chamber, the at least one channel being defined by energy minima of the angular trapping component, and a radial balancing component having a magnitude increasing monotonically with increasing radius from the rotation axis, at least in the vicinity of the at least one channel; rotating the angular trapping component about the rotation axis, whereby charged particles, angularly constrained along the at least one channel by the angular trapping component, rotate therewith such that a centrifugal force acts on the charged particles, the charged particles moving along the at least one channel under the combined influence of the centrifugal force and the radial balancing component to form one or more particle orbits according to the charge to mass ratios of the particles; and detecting at least one of the particle orbits.

In WO-A-03/051520, the requirement for a buffer solution means that it is not possible to deduce any absolute information from the sample, for example the particle's mass, composition etc. However, by using angular energy minima to create channels along which the charged particles are trapped, as set out in claim 1, particles can be arranged according to their q/m ratio along the channels without the need for physical cavities or buffer solution. This not only enables the absolute mass of the particles to be determined (since buoyancy effects of the buffer solution are eliminated) but also greatly simplifies the spectrometer apparatus. In addition, since multiple orbits can form simultaneously, different particle types can be analysed concurrently and across a dynamic q/m range which far exceeds that of conventional devices. Further, since there are no physical cavities, the device parameters (such as number, shape and length of the "virtual" channels) can be changed as desired for each application, simply by adjusting the applied field(s). This can even be performed dynamically (i.e. during a spectrometry process) if desired.

It should be noted that the angular trapping component acts on the particles angularly: that is, particles move under its influence around the rotation axis at a constant radius (in the absence of any other influences). The radial balancing component acts on the particles along a radial direction (i.e. perpendicularly to the angular component). Whilst in many cases the direction in which the fields act (i.e. the direction of a force on a particle arising from the field) will be parallel with the direction of the field itself (such as in the case of an electric field), this need not be the case. For instance, a magnetic field will lead to a force arising on a charged particle which is perpendicular to the direction of the field. What is important is that the directions in which the field components act on a particle (i.e. the directions of any forces arising) are angular and radial, respectively.

The radial balancing component counters the centrifugal force on the particles such that each particle moves along its "virtual" channel to a position of radial equilibrium at which the magnitude of the centrifugal and (radial) electric forces are equal. Since the so-arranged particles are rotating, particle orbits are created at each equilibrium radius, and the positions of these orbits can then be measured using the detector to derive a variety of results. As will be described further below, the apparatus can be used for many purposes, including particle separation (sorting), mass determination, substance identification and substance detection as well as purification.

The magnitudes of the angular and radial components can be selected from a broad range according to the type of particles under test and the conditions in the chamber. Generally speaking, higher q/m particles will require a weaker radial balancing field component than low q/m particles. In preferred embodiments, the magnitude of the maximum angular field component at any one radius is of the same order of magnitude as that of the radial field component at that radius. This has been found to assist in the settling of particles along each channel but is not essential.

In a first example, the angular trapping component is provided by an angular trapping field, and the radial balancing component is provided by a radial balancing field. Thus, two separate fields are applied and superimposed on one another to provide the necessary components. As will be described later, the angular trapping field and radial balancing field can each be electric fields or the angular trapping field can be an electric field whilst the radial balancing field is a magnetic field. The use of two separate fields enables each to be controlled independently of one another.

In a second example, the angular trapping component is provided by an angular trapping field, and the radial balancing component is a component of the angular trapping field. Thus, the angular trapping component and the radial balancing component may both be provided by a single field. This reduces the complexity of the field generating means and allows the particle orbits to be controlled by a single field.

The energy minima are points where the angular force acting on a particle due to the field(s) is at a minimum. Preferably, the energy minima correspond to points of substantially zero angular field magnitude. The minima typically may not correspond to the 'lowest' (i.e. most negative) points of the angular field. In use, the charged particles will migrate towards the energy minima under the influence of the angular field component, and will be retained in the vicinity of the minima since to move away from the minima will involve an increase in the particle's energy. It should be noted that the particles may not settle exactly on the minima due to damping effects as will be discussed below.

Preferably, the energy minima correspond to zero crossing points in the angular trapping field. That is, on one (angular) side of each minimum the field is positive, and on the other side it is negative. Thus, the angular field switches direction at the energy minima. This creates a particularly stable particle 'trap' along the minima since particles will be urged toward the minima by the opposing field on either side. However, not all such zero-crossing points will provide stable equilibrium for all particles: since positively charged particles will experience a force opposite to that on negatively charged particles, zero-crossing points at which the field switches from positive to negative will provide stable traps for positive ions, where as those at which the field switches from negative to positive will provide stable traps for negative ions.

Preferably, the energy minima defining the or each channel are continuous along the or each channel. That is, every point along the channel is an angular minima. The continuous minima enable the charged particles to position themselves along the channel according to their charge to mass ratio. A single such channel could be created if desired. However, if all of the particles are trapped at one locality, the effects of self-repulsion can be high. As such, preferably, there will be more than one such channel created by the angular trapping field such that the charged particles can form bunches of similar charge to mass ratio particles in each of the channels.

In preferred examples, the at least one channel extends from the rotation axis to the periphery of the chamber. It is envisaged that the length of the channel can be any length between the rotation axis and the periphery of the chamber. However, the longer the length of the at least one channel, the greater the number of particle orbits that can be set up within each channel. Therefore, ideally the length of the channel will be the total distance between the rotation axis and the periphery of the chamber to ensure the longest possible channel. In other examples, the or each channel could be divided into more than one sub-channels by inserting energy maxima in the field(s). This could be useful for analysing more than one mass to charge ratio window simultaneously.

Preferably, the at least one channel is a radial channel. That is, it follows a rectilinear path between the rotation axis and the periphery of the chamber. The at least one channel extends radially for any finite length between the rotation axis and the periphery of the chamber. In other examples, the channel can follow a non-linear path between the rotation axis and the periphery of the chamber. For instance, in certain advantageous embodiments, the at least one channel follows an arcuate path between the rotation axis and the periphery of the chamber. For example, at least one spiral shaped channel may be provided between the rotation axis and the periphery of the chamber. The use of an arcuate (or other non-linear) channel increases the length of the channel and thus increases the number of particle orbits that can be contained within the channels, allowing a greater number of different charge to mass ratio particles to be analysed. The arcuate channels can tessellate with one another to increase the capacity of the chamber to accommodate the channels. The arcuate channels are formed from energy minima as previously described.

In preferred examples, at each radius the angular trapping field follows an alternating profile around the rotation axis. That is, the angular trapping field alternates in sign about the rotation axis, to provide energy minima corresponding to zero-crossing points in the field as previously described. In particularly preferred embodiments, the angular trapping field component follows a sinusoidal profile, but it could also have any other angularly alternating profile such as a square or triangular wave profile.

In many implementations, the angular trapping component will be established around the full circumference of the chamber. However this is not essential since in some preferred embodiments the field generating apparatus is adapted to establish the angular trapping component only in an angular subsection of the chamber defined about the rotation axis (subtending an angle of less than 360 degrees). This can be desirable since the components needed to apply the necessary field (e.g. electrodes) can then be confined to that subsection of the chamber.

Preferably, the angular trapping field is an electric field. The electric field creates the channels as described previously. Alternatively, the angular trapping field could be a magnetic field.

In preferred examples, the field generating apparatus comprises an angular field electrode assembly, the angular field electrode assembly comprising a plurality of trapping electrodes or trapping electrode elements and a voltage supply arranged to apply a voltage to at least some of the trapping electrodes or trapping electrode elements. The electrodes may typically be disposed in a plane perpendicular to the rotation axis, for example on an upper or lower surface of the chamber (or both). The electrode configuration chosen will depend on the desired field shapes and the degree of device flexibility required.

For example, in some preferred embodiments, the angular field electrode assembly comprises at least two trapping electrodes extending between the rotation axis and the periphery of the chamber, the trapping electrodes preferably being substantially equally angularly spaced about the rotation axis. Where the angular field is only to be established in an angular subsection of the chamber, this subsection may be defined between the two electrodes, and if more electrodes are provided they may be equally angularly spaced within that subsection. Depending on the voltage level applied to each trapping electrode, a peak or a trough will be created in the voltage field following the shape of the electrode, which will correspond to energy minima in the resulting electric field (since the electric field is related to the spatial derivative of the voltage distribution). By arranging the electrodes to be equally spaced, a rotationally symmetrical electric field can readily be implemented (if so desired).

Alternatively, the angular field electrode assembly could comprises at least two arrays of trapping electrode elements, each array extending along a respective path between the rotation axis and the periphery of the chamber, the arrays preferably being substantially equally angularly spaced about the rotation axis (with the same considerations as indicated above applying to implementations where only an angular subsection of the field is created). Thus, effectively, each trapping electrode comprises an array of individual electrode elements. The array of electrode elements can have an individual voltage applied to each electrode element, permitting greater control of the field as will be discussed later.

Preferably, the at least two trapping electrodes or at least two arrays each extend radially between the rotation axis and the periphery of the chamber. That is, each trapping electrode or array is rectilinear and extends between the rotation axis and the periphery of the chamber. Such an arrangement will establish radial channels in the angular field as previously described. Each trapping electrode or array need not extend the whole distance between the rotation axis and the periphery of the chamber but may extend from any point between the rotation axis and the periphery of the chamber and any other point within this range. However, to maximize the length of the channels, the electrodes or arrays preferably extend from the rotation axis to the periphery of the chamber.

In other preferred examples, the at least two trapping electrodes or arrays each follow an arcuate path between the rotation axis and the periphery of the chamber. This configuration allows spiral channels to be created as described previously. The arcuate path of the electrode or array can extend to any point between the rotation axis and a periphery of the chamber and does not necessarily have to extend the whole distance between the rotation axis and the periphery of the chamber.

If it is not desired to fix the shape of the channels by virtue of the electrode/array paths, in particular preferred embodiments the angular field electrode assembly comprises a two dimensional array of trapping electrode elements disposed between the rotation axis and the periphery of the chamber, the trapping electrode elements preferably being arranged in an orthogonal grid pattern, a hexagonal grid pattern, a close-packed pattern or a concentric circle pattern, Thus, the shape of the channels can be selected as desired by applying appropriate voltages to some of all of the elements in the 2D array.

In some examples, the angular field component could be rotated by rotating the angular field electrode assembly relative to the chamber. Thus, the field generating apparatus may further comprise a rotating mechanism adapted to rotate the angular field electrode or the chamber, such as a motor with the angular field electrode assembly mounted to it.

However, in a preferred implementation the voltage supply is adapted to sequentially vary the voltage applied to the or each trapping electrode or trapping electrode element such that the angular trapping field rotates about the rotation axis. Varying the voltage sequentially on each of the trapping electrodes allows a rotating voltage to be applied to the electrodes and have the same effect as a rotating mechanism as described previously.

Preferably, the or each trapping electrode or element has a finite (non-zero) resistance such that the voltage varies along the length of the or each trapping electrode. Advantageously, the magnitude of the voltage (irrespective of sign) on the or each trapping electrode or array is lower at the end of the or each trapping electrode or array towards the rotation axis than at the end of the or each trapping electrode towards the periphery of the chamber. Typically, a ground voltage will be applied at the end of the trapping electrode towards the rotation axis and a higher magnitude voltage applied to the end of the electrode toward the periphery of the chamber. The voltage varies along the length of the trapping electrode since the trapping electrode preferably has a finite resistance. This assists in forming an electric field shape which is continuous across the rotation axis. In one example, the or each trapping electrode or element comprises a resistive polymer or silicon. Such materials are preferred since they have an intrinsic resistance of known value, whereas conventional conductive electrode materials (typically metallic) have a resistance close to zero and this cannot be adjusted.

As already described, the radial balancing component has a magnitude which increases monotonically with increasing radius, at least in the (angular and/or radial) region of each channel. A monotonically increasing function is one for which the derivative of the function's magnitude is always positive. It should be noted that this applies irrespective of the field's sign: thus, in the case of a negative field, the absolute field value will decrease (i.e. become more negative) with radius but nonetheless, the field strength will always increase with radius. Thus, the magnitude of the radial balancing component always increases with radius. This is necessary in order to arrive at points of stable equilibrium between the outward centrifugal force and inwardly acting radial balancing component. Any monotonically increasing function could be selected. However, preferably, the radial balancing component has a magnitude which increases with $r^n$ where n is greater than or equal to 1 and r is the radial distance from the rotation axis. For example, the radial balancing field component could increase proportionally (linearly) with radius, quadratically or otherwise.

In a preferred example, at each radius the magnitude of the radial balancing component is constant around the rotation axis, at least at angular positions corresponding to the or each channel. The magnitude of the radial balancing component need not be constant around the rotation axis. However, by arranging its magnitude to be constant at least at each of the channels, the equilibrium points will be at the same radius around the rotation axis, leading to circular (or near circular) orbits such that they can be more accurately measured.

In certain examples, at each radius the magnitude of the radial balancing component varies around the rotation axis.

Where the radial magnitude is non-constant with angular position, preferably the radial balancing component rotates synchronously with the angular trapping component to ensure that the appropriate radial field is aligned with each channel. Preferably, the field generating apparatus is further adapted to rotate the radial balancing component about the rotation axis synchronously with the angular trapping component.

In a particularly advantageous embodiment, the radial balancing component has a first direction in at least one first angular sector of the chamber, and a second direction opposite to the first direction in at least one second angular sector, the first and second angular sectors corresponding to first and second channels of angular minima. That is, in the vicinity of selected channels, the radial balancing component will act inwardly on positive particles and outwardly on negative particles, whereas for other selected channels, the opposite will be true. This enables both positive and negative charged particles to be analysed simultaneously.

In a preferred implementation, the radial balancing field is a magnetic field. The magnetic field establishes a force on the particles which balances the centrifugal force so that the charged particles form one or more particle orbits according to their charge to mass ratio. This occurs by virtue of the moving charged particles creating a current, which is subject to the Lorentz force. In such embodiments the field generating apparatus preferably comprises a magnet assembly. The chamber is placed between the opposite poles of the magnet assembly such that the magnetic field created between the opposite poles of the magnet assembly passes through the chamber.

Preferably, the magnet assembly comprises an electromagnet, since this permits the creation a strong magnetic field and is easily controlled. However, any other magnetic field generating apparatus may also be considered, such as permanent magnets.

Advantageously, each pole of the magnet assembly has a varying surface profile which extends further towards the chamber at the chamber periphery than at the rotation axis, shaped so as to establish a monotonically increasing radial field, preferably having a concave surface profile. The strength of the magnetic field created is thus non-homogeneous through the cross section of the chamber. The varying surface profile reduces the magnitude of the magnetic field towards the rotation axis, since here the distance between the two pole pieces is at a maximum. The shape of the pole surface provides the required monotonic increase in magnetic field strength with radius. Alternatively, a similar non-homogeneous magnetic field could be created by using at least two different magnetic materials arranged concentrically inside each other to create the poles of the magnet, each of the magnetic materials having a different magnetic strength and creating the desired reduced magnetic field towards the rotation axis.

In other preferred implementations, the radial balancing field is an electric field. Here, the field generating apparatus preferably comprises a radial field electrode assembly comprising at least one balancing electrode disposed adjacent the chamber having a radial profile shaped so as to establish a monotonically increasing radial field when a voltage is applied thereto. Advantageously, the balancing electrode has a centre aligned with the rotation axis, and a substantially circular periphery thereabout, the thickness of the balancing electrode varying between the centre and the periphery of the balancing electrode to establish a monotonically increasing radial field. It is also envisaged that an array of balancing electrode elements could be used to create the desired effect.

Preferably, the balancing electrode is a cone with straight, concave or convex sides. The shape of the electrode's sides can be varied to create the desired profile of the radial balancing component. Advantageously, the apex of the cone extends towards or away from the chamber.

Preferably, the field generating apparatus further comprises a voltage supply arranged to apply a voltage to the at least one balancing electrode. The voltage supply can preferably support an adjustable voltage output.

Advantageously, the or each balancing electrode is preferably formed of a solid resistive polymer or silicon. As described previously with regard to the angular field electrodes, such materials are used so to ensure the electrode has sufficient resistance so as to enable the desired electric field profile to be generated.

Preferably, the radial field electrode assembly further comprises a second balancing electrode, the chamber being disposed between the first and second balancing electrodes. The use of a second balancing electrode with the chamber in between the first and second balancing electrode helps to avoid the field shape being distorted in the axial direction. Preferably, the second balancing electrode is formed in the same manner as the first balancing electrode and from the same material to ensure the created field profile is symmetrical.

Other electrode assemblies can also be used to implement the radial field. In a preferred example, the field generating apparatus comprises a radial field electrode assembly having a plurality of annular electrodes arranged in concentricity with the rotation axis and spaced from one another by dielectric material, and a voltage supply arranged to apply a voltage to each of the annular electrodes.

In the aforementioned examples, the radial and angular components are each established by separate fields and are superimposed on one another. However, in an alternative implementation, the radial balancing component can be provided by the angular trapping field. Thus the field generating means used to establish the angular trapping field may be modified accordingly and there is no need for any additional field generating components. Hence, preferably, the angular field electrode assembly is configured such that the voltage on the or each trapping electrode varies between the end of the or each trapping electrode towards the rotation axis and the end of the or each trapping electrode towards the periphery of the chamber so as to establish a monotonically increasing radial field. This can be performed using electrodes formed of suitably profiled resistive material or via the use of electrode elements arranged in an array along each channel, for example. If an array of elements is provided, the shape of the radial component can be controlled precisely and varied as desired by applying suitable voltage levels to each element.

A two dimensional grid of such electrode elements could alternatively be provided across at least a portion of the chamber such that the shape of each channel is not fixed by the electrodes' layout but rather can be selected by appropriate application of voltages to some or all of the electrode elements.

Preferably, the chamber has a circular cross section substantially perpendicular to the rotation axis. A circular cross section is preferred for the chamber since the particle orbits of charged particles will tend to be circular (or near circular) unless the radial balancing component is designed to varying in magnitude around the rotation axis. The use of a chamber with circular cross section is therefore the most efficient use of space. However, this is by no means essential since a chamber of any shape could be used, including cubic or rectangular chambers. In particularly preferred examples, the chamber is a disc or a cylinder, with the rotation axis parallel to the axis of the chamber and intersecting the chamber. In other examples, the chamber may have an annular cross section substantially perpendicular to the rotation axis. Thus, the rotation axis may pass through the central "hole" rather than intersect the chamber itself. Chamber configurations with non-circular cross sections can also include a central "hole" if desired, circular or not.

Preferably, the chamber is a vacuum chamber, and the mass spectrometer further comprises apparatus for controlling the atmosphere within the chamber, preferably an evacuation device or a pump. The use of a controlled atmosphere within the chamber enables aerodynamic drag on the particles to be kept to a minimum, which could otherwise distort the results, and reduces spurious results due to additional substances existing within the chamber.

In particularly preferred embodiments, the apparatus for controlling the atmosphere within the chamber is adapted to maintain an imperfect vacuum within the chamber (i.e. a controlled, low pressure of gas). The provision of a low gas pressure within the chamber enables the particles to move freely whilst providing a damping effect which helps to retain the particles along each channel. This however is not essential since the field(s) can instead be shaped to provide strong localisation within which a degree of oscillation about the energy minima is acceptable.

In other cases it may be preferable to make use of a higher gas pressure within the chamber and so the pump may be arranged to maintain an increased pressure within the chamber. This may be appropriate, for example, where it is desired to analyse massive particles, such as cells, at relatively low angular velocities and high applied field strengths. In such cases, too low a gas pressure could lead to breakdown of the controlled atmosphere due to the high applied fields. Paschen's law shows that the breakdown voltage increases with pressure at higher pressures, and so use of a higher gas pressure can avoid breakdown occurring.

Where a damping effect is provided (e.g. by virtue of a controlled gas atmosphere within the chamber), it is preferable that the maximum angular field component at any one radius is of sufficient magnitude to overcome the damping force on the particles. For instance, where the damping is provided by a gas, the force on a particle due to the maximum angular field component should be greater than the frictional force on the particle due to its contact with the gas. This has been found to assist in retaining the particles within each channel but is not essential.

In certain examples the mass spectrometer may receive pre-charged particles. However, preferably the spectrometer further comprises an ionisation device adapted to ionise the particles prior to injection into the chamber. Suitable ionisation devices are well known and include electron ionisation, in which particles are passed through an electron beam, and chemical ionisation in which the analyte is ionised by chemical ion-molecule reactions during collisions. The ionisation device can be separate from the injection device or both could form an integral component. Typically the injection device will comprise an accelerating electrode which, when a voltage is applied, will attract the charged particles towards it and into the chamber. If both positive and negative particles are to be analysed, two such injection devices may be provided, or the electrode could be switched between positive and negative voltages. The injection device could be disposed at any location on the chamber, e.g. tangential to the chamber periphery, on the interior of the chamber (e.g. at the central "hole" of the chamber if provided), or on the upper or lower surfaces of the chamber at any radial position.

Advantageously, the field generating apparatus further comprises a controller adapted to control the field generating apparatus to enable varying of the magnitude and/or shape of the angular trapping component and/or radial balancing component. The controller could be a computer or programmable voltage supply. In preferred implementations, the magnitude and/or shape of the radial balancing component is varied during movement of the charged particles so as to adjust the radii of the or each particle orbits. The angular trapping component may also be varied, for example in terms of its rotational frequency (and therefore angular velocity), and/or the shapes of the channels.

As already mentioned, the spectrometer can be used in many different applications and as such various different detection techniques may be appropriate. In certain examples, the detector is adapted to measure the radius of at least one of the orbits of particles. This is particularly the case where it is desired to determine the mass of a particle, or where the compositions of the particles are unknown. By measuring the radius of the orbit, the mass of the particle(s) forming the orbit can be deduced, which can in turn be used to ascertain their composition.

However, in many other applications, a measurement of radius is not necessary. For example, where the masses of the particles under investigation are known, the radii at which the orbit will form will also be known. Therefore, in certain examples, the detector is adapted to detect a particle orbit at one or more predetermined radii. In a fixed (known) field configuration, the detection of particles at a predetermined radius will confirm that a certain substance is present. Alternatively, the magnitude of the radial field component could be adjusted 'on the fly' to bring an orbit into coincidence with a detector at a known radial position, the field adjustment applied in order to do so being used to determine the particles' mass.

In further examples, the detector may be adapted to detect the density of particles at the or each particle orbit. The density of particles will result in a different response from the detector and the varying density of each particle orbit can be measured accordingly. This can be used to determine isotopic concentrations, for example. In other implementations, the detector may be arranged simply to detect the number of orbits in a given area, for example to determine the number of different particle types in a sample.

The detector can take many forms. In one preferred example, the detector comprises at least one radiation absorbing element arranged so as to detect radiation transmitted through the chamber. Radiation will generally be absorbed by particles within the chamber, such that the reduction of radiation intensity received by the or each detector element will be indicative of particles at the position of that detector element. Individual detector elements could be disposed at one or more predetermined radii. However, preferably, the detector comprises an array of radiation absorbing elements arranged along a radial path between the rotation axis and the chamber periphery. Such an arrangement can be used to detect orbits at unknown radii and/or to measure the resulting radii. In other examples, the whole chamber area could be imaged, which has the advantage that the detector need not be precisely positioned relative to the rotation axis in order to accurately determine the radius, since the whole orbit can be measured and its radius calculated from a measurement of the orbit's diameter. Hence, the detector could comprise a plurality of radiation absorbing elements arranged over the surface area of the chamber, enabling a large number of measurements to be received at one time.

Such absorbing elements may detect ambient radiation. However, preferably, the detector comprises a radiation emitter and the absorbing elements are arranged to detect the emitted radiation. Thus, interfering radiation sources can be excluded from the detector. In particularly preferred examples, ultraviolet, infrared, or visible radiation may be selected, but any wavelength could be adopted.

In other implementations, it is desirable to extract particles from the chamber once the orbits have been formed. Hence, in a further preferred example, the detector comprises a collection device adapted to collect charged particles from one or more particle orbits. Advantageously, the collection device comprises at least one exit point in the chamber adapted to enable charged particles on particle orbit(s) of predetermined radii to exit the chamber, at least one exit electrode disposed outside the chamber adjacent the exit point, and a voltage supply for applying a voltage to the at least one exit electrode such that, when a voltage is applied to the at least one exit electrode, charged particles on particle orbit(s) of predetermined radii are accelerated towards the at least one exit electrode. Thus, in use the exit electrode has a potential difference applied to it so that the charged particles adjacent the exit point are attracted out of the chamber through the exit point. The applied voltage will be of opposite sign to the charge on the particles to be removed from the chamber. If both positive and negative particles are to be extracted, two such collection devices may be provided, or the voltage on a single such device could be switched as necessary. The provision of such a collection device enables the spectrometer to be used for purifying a substance. For example, the collection device can be positioned such that only certain particles with one desired charge to mass ratio will be extracted from the chamber. Alternatively, the fields could be varied 'on the fly' such that particles can be collected from a series of orbits in succession.

The spectrometer can be operated in a number of different ways. In one aspect, the invention provides a method of separating a mixed sample of charged particles, comprising injecting the mixed sample of charged particles into a chamber and performing the above-described method of mass spectrometry. The separated particles can be detected using any of the above mentioned detection techniques.

In another aspect, the invention provides a method of measuring the mass of a charged particle, comprising injecting a sample of charged particles into a chamber, performing the above-described method of mass spectrometry, measuring the radius of at least one particle orbit and calculating the mass of the particle(s) based on the at least one measured radius.

Another aspect of the invention provides a method of detecting a target particle, comprising injecting a sample of particles into a chamber, performing the above-described method of mass spectrometry and detecting particles at one or more predetermined radii, wherein at least one of the predetermined radii corresponds to the known mass of the target particle, detection of charged particles at the at least one predetermined radii indicating the presence of the target particle.

In another aspect of the invention, a method of extracting a target particle from a mixed sample of particles is provided, comprising injecting the mixed sample of particles into a chamber, and performing the above-described method of mass spectrometry using a collection device to extract particles from a selected particle orbit having a radius determined based on the mass of the target particle. Preferably, the mixed sample of particles is continuously injected into the chamber and particles are continuously extracted from the selected particle orbit, the apparatus therefore acting as a purification device.

Examples of spectrometers and spectrometry methods will now be described with reference to the accompanying drawings, in which:-

Figure 10:
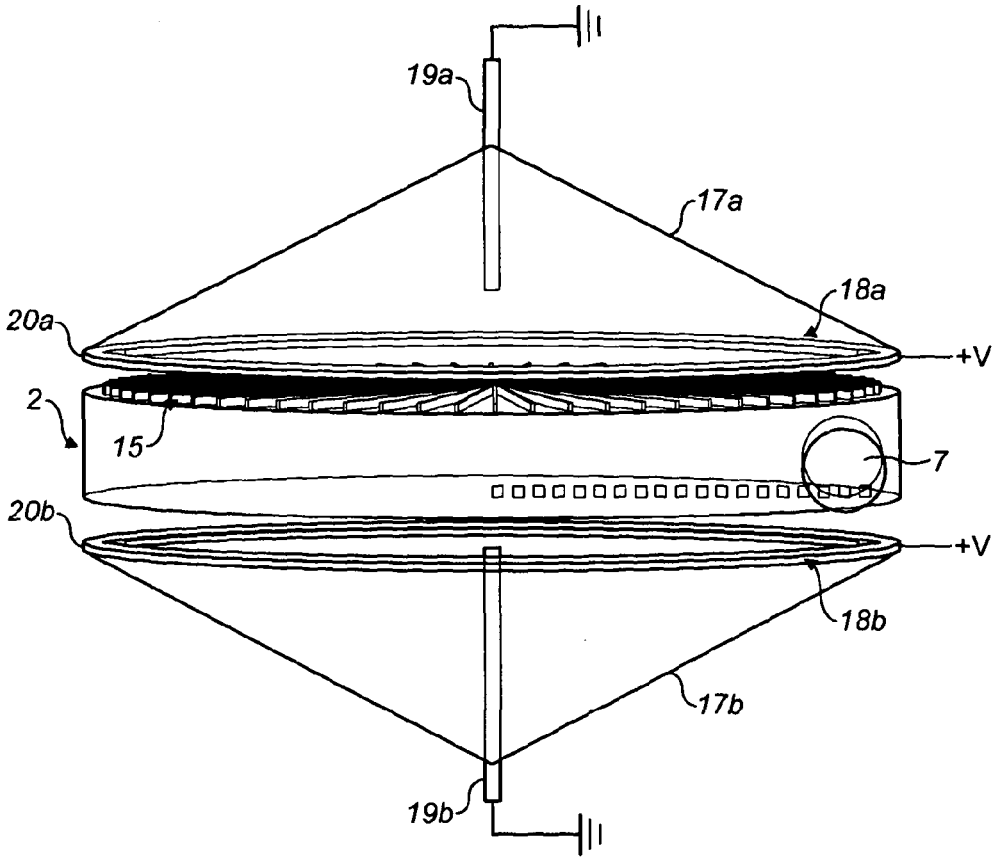
FIG. 10 illustrates components suitable for establishing a radial field component in the first embodiment.
Figure 10A:
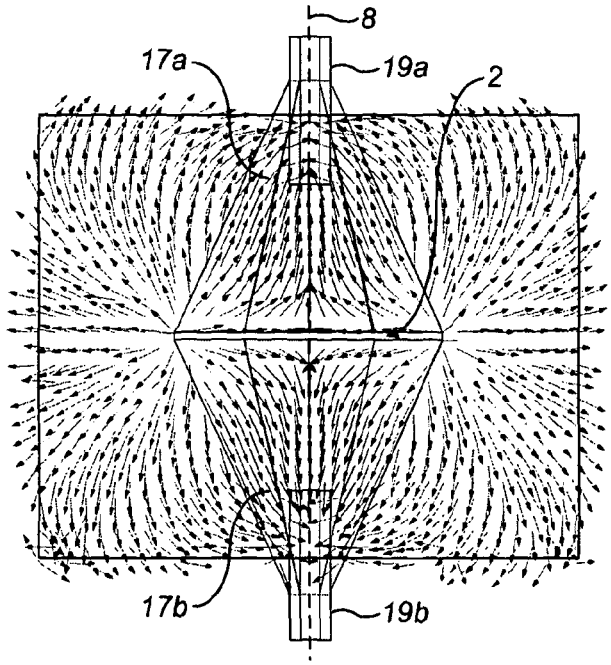
Figure 10B:
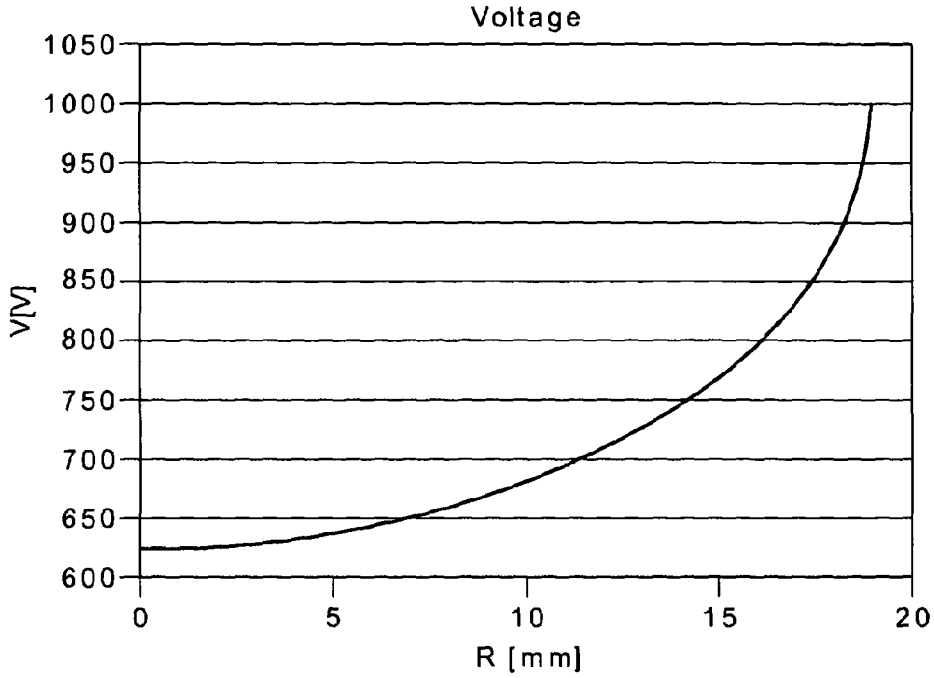
Figure 10C:
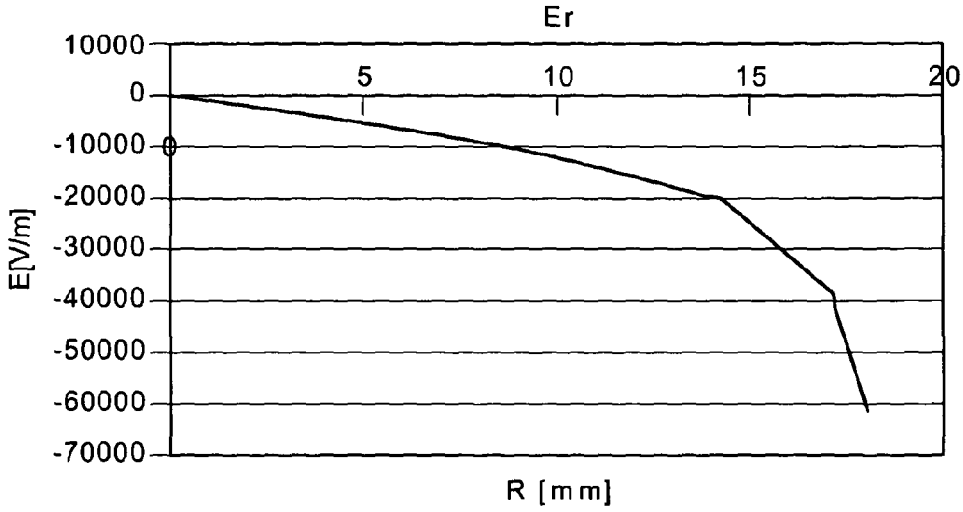

FIG. 10*a* is a vector plot illustrating an electric field applied using the components of FIG. 10;

FIGS. 10*b* and 10*c* are plots showing the radial voltage distribution and radial electric field within the chamber shown in FIG. 10*a;*

Figure 11:
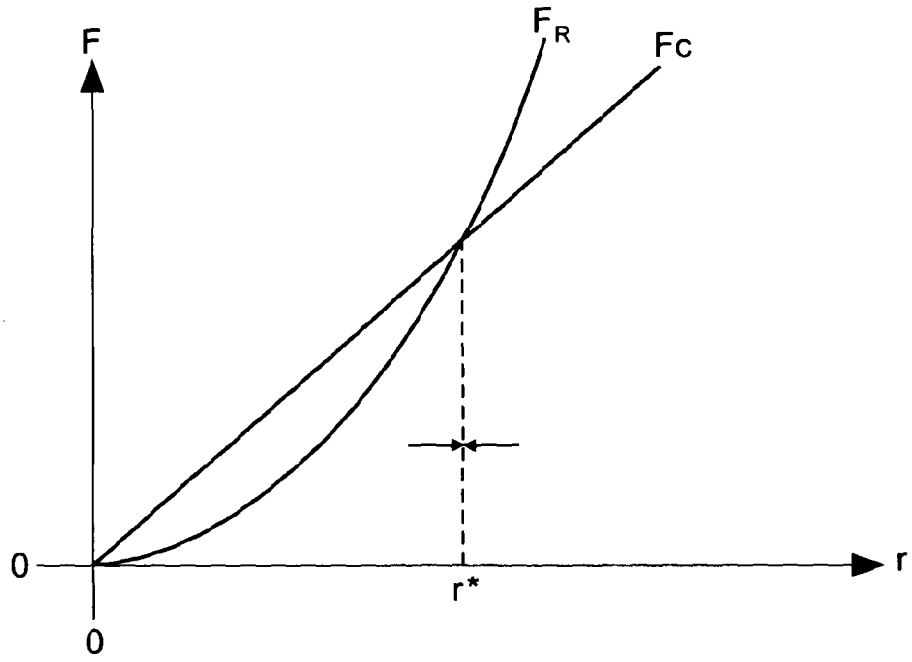
Figure 12:
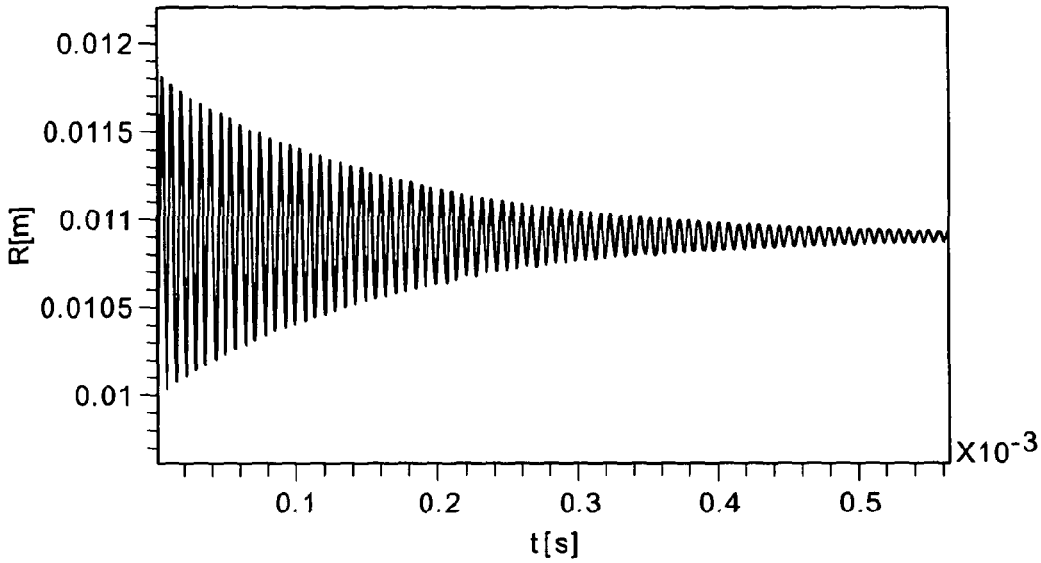
Figure 13:
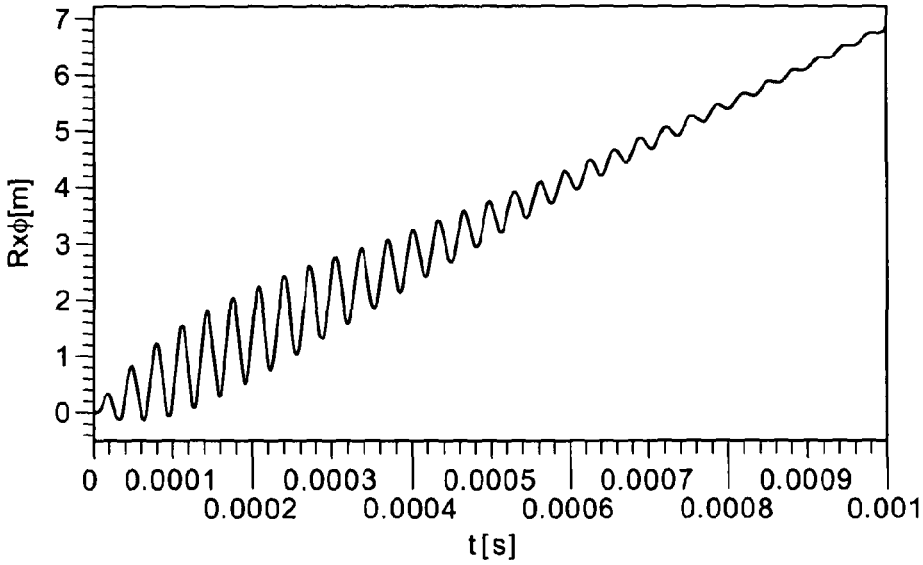
Figure 14:
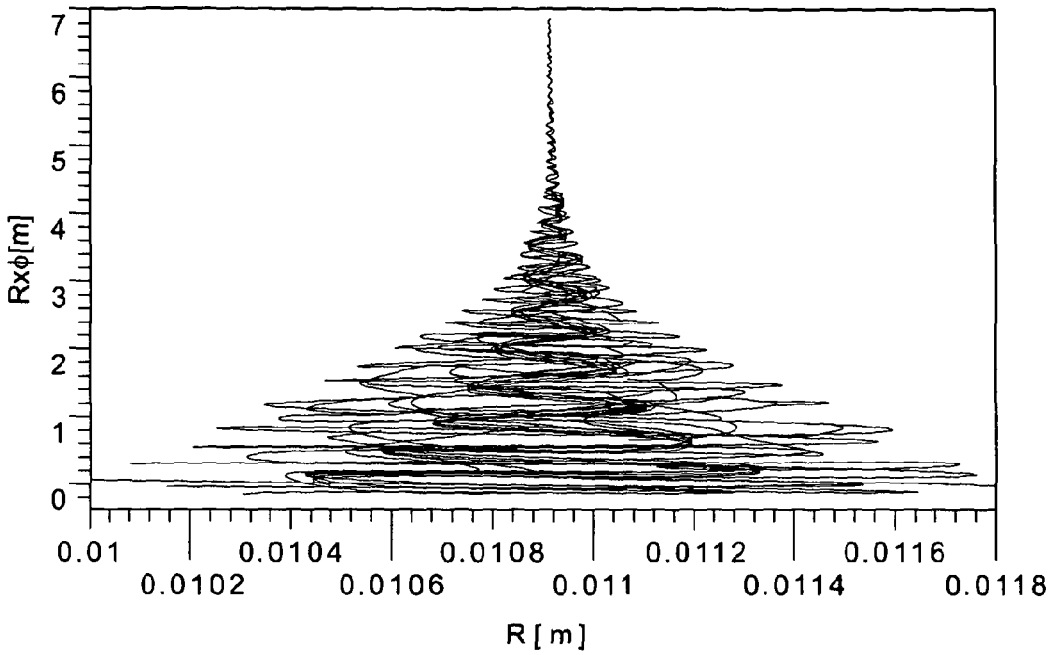
Figure 15:
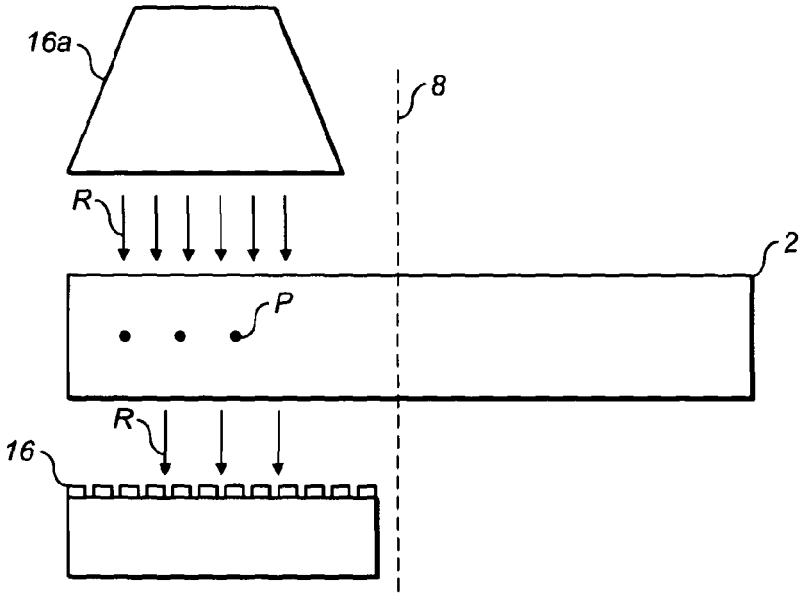
Figure 15A:
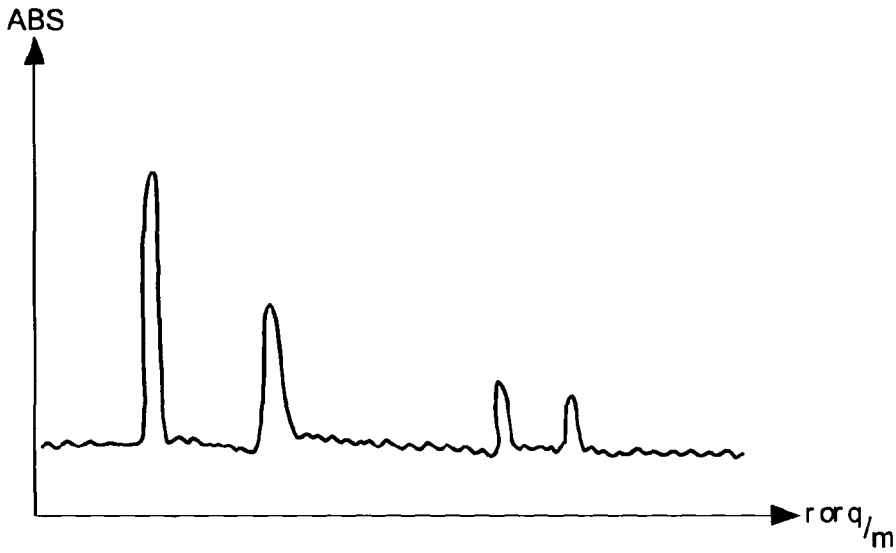
Figure 16:
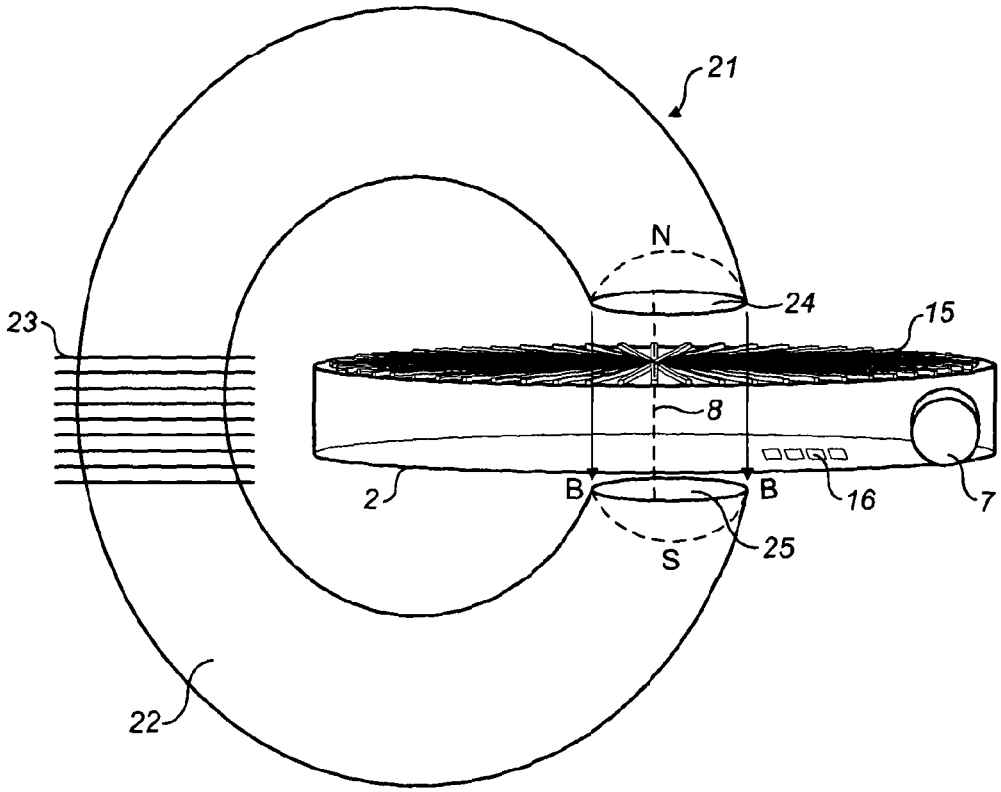
Figure 17:
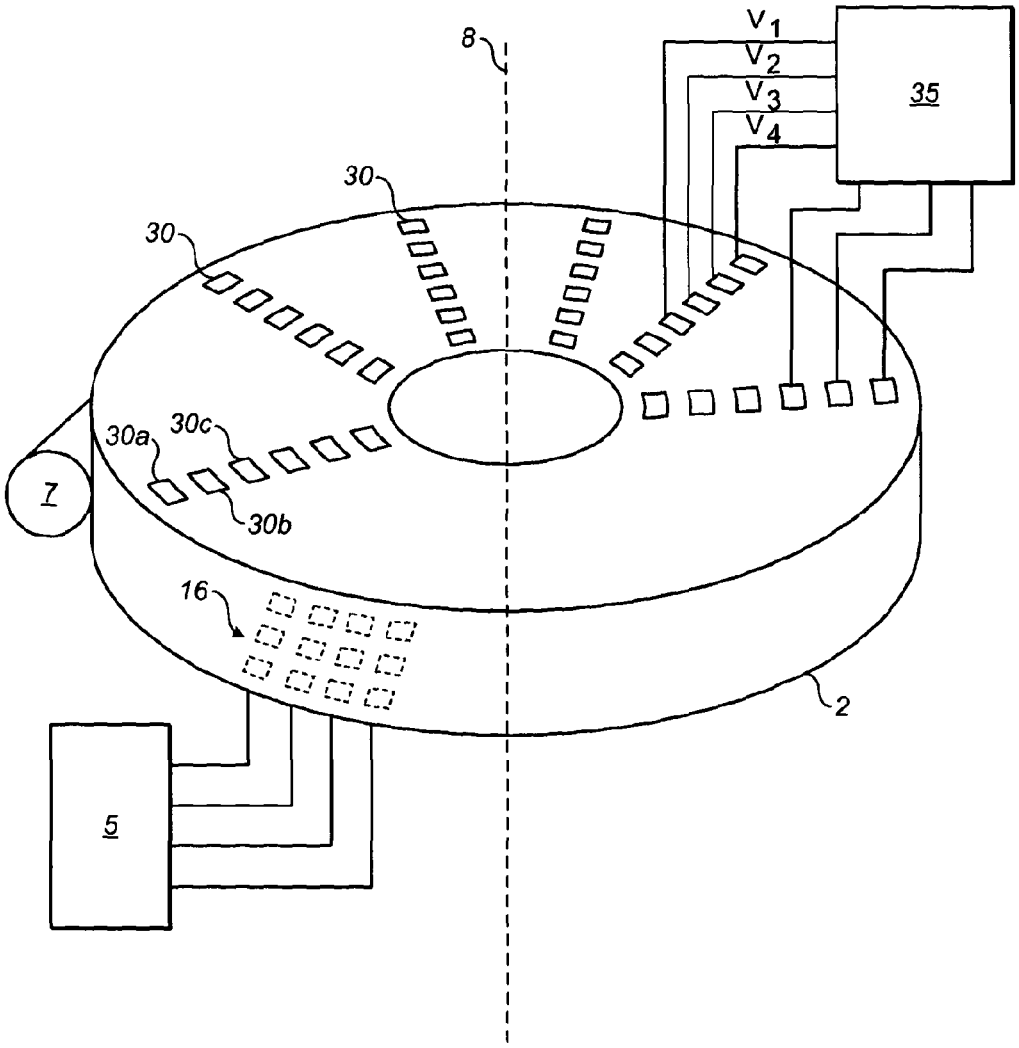
Figure 18:
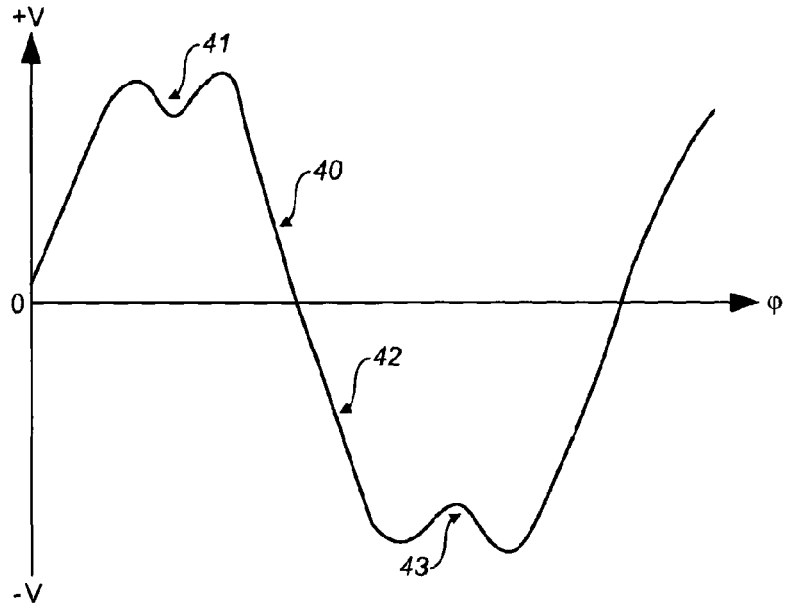
Figure 19:
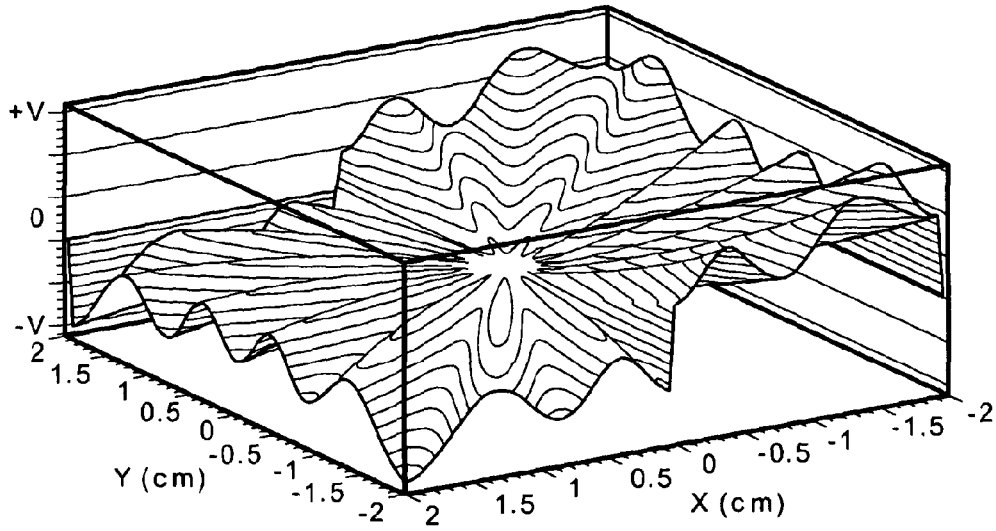
Figure 20:
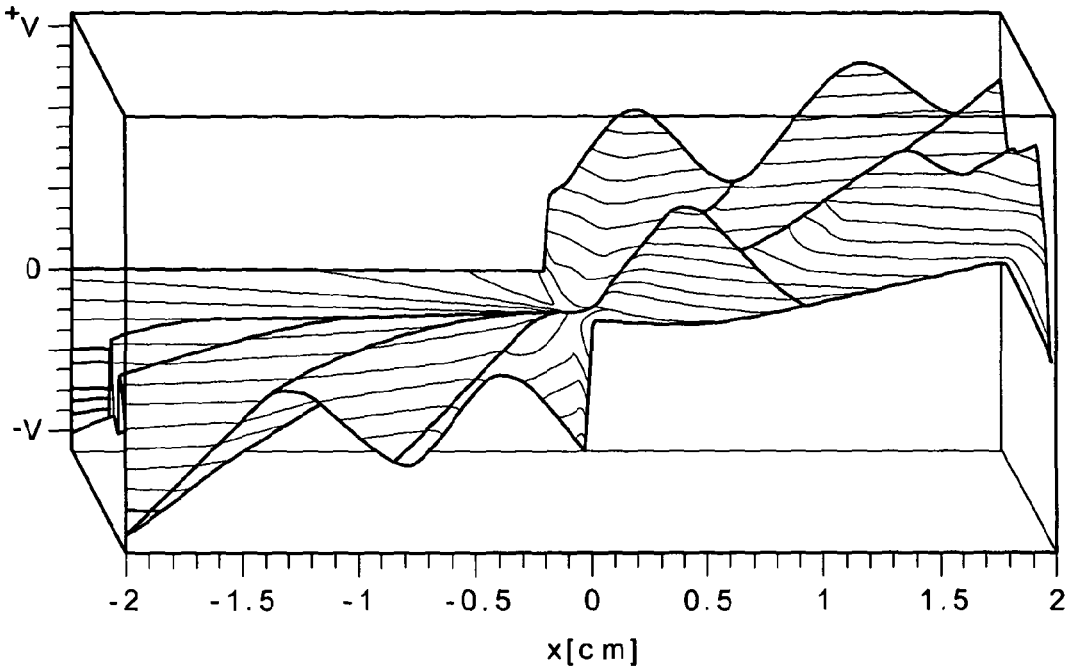
Figure 21:
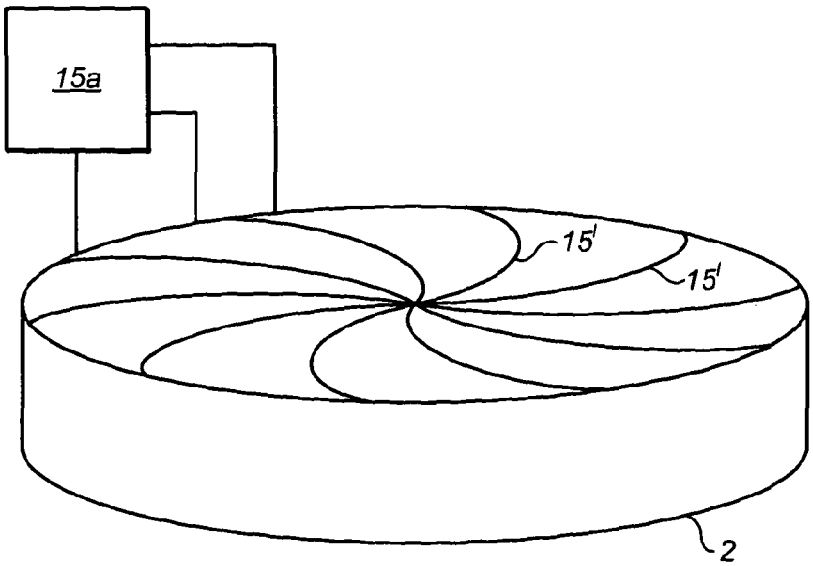
Figure 22:
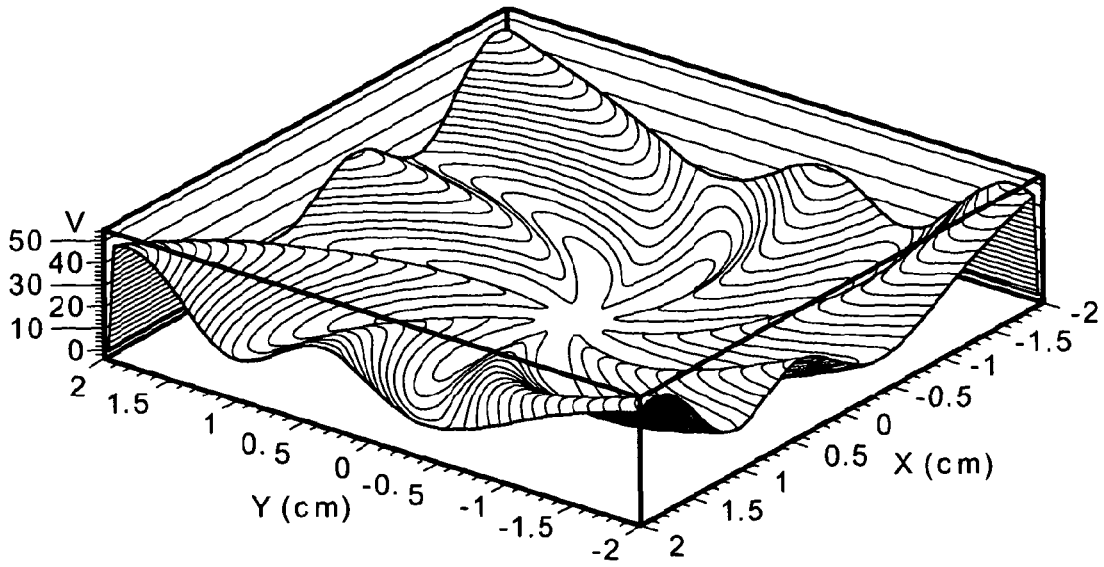
Figure 23A:
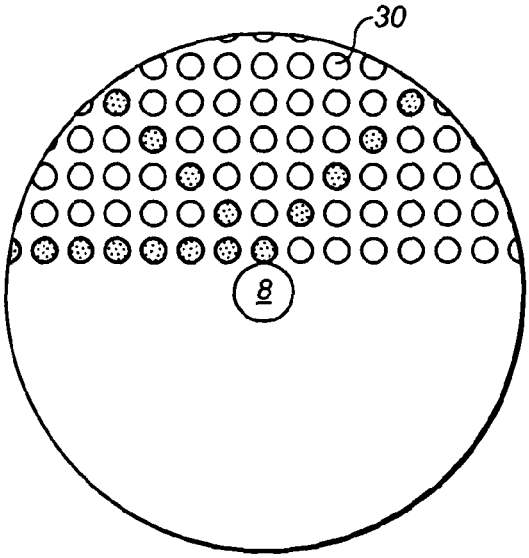
Figure 24A:
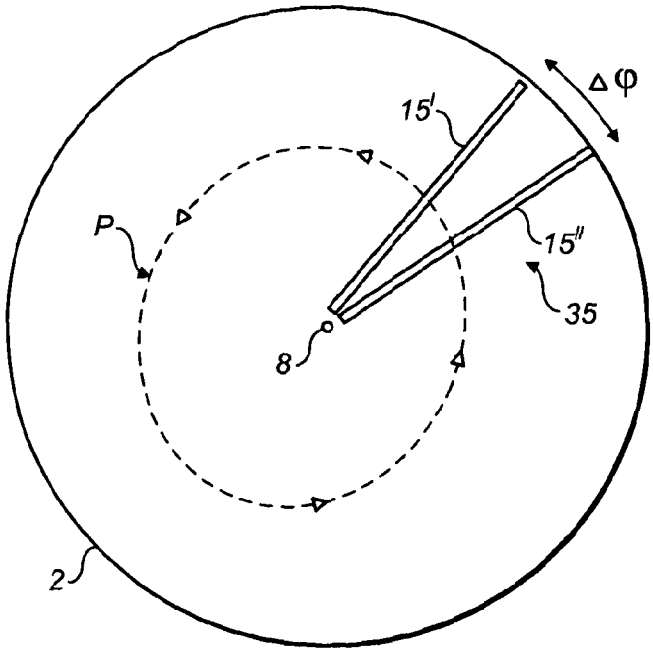
Figure 24B:
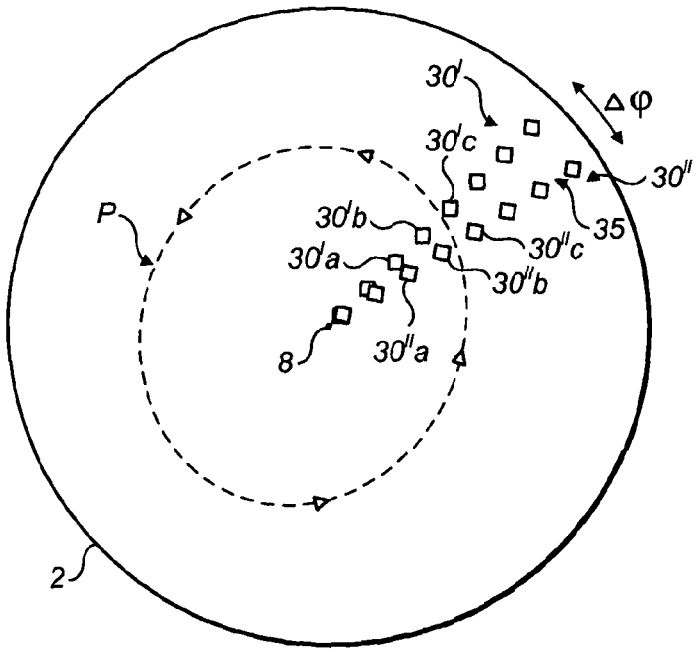
Figure 25A:
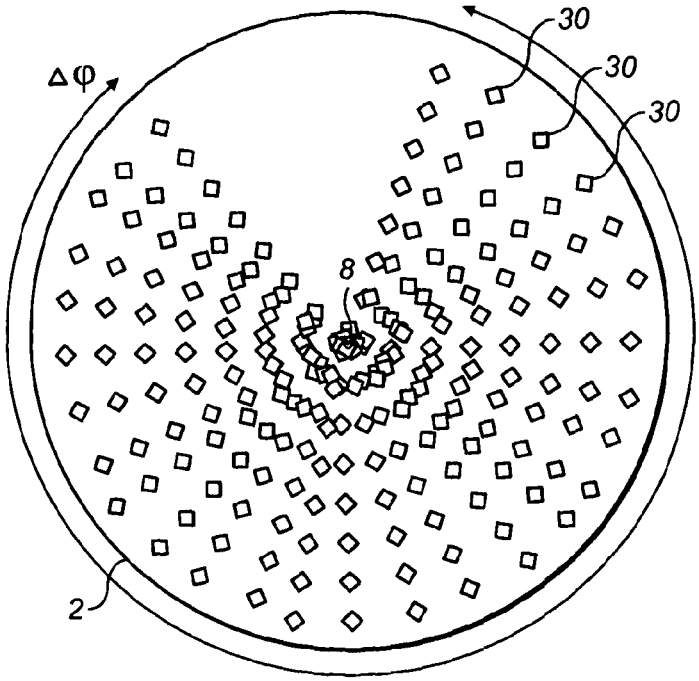
Figure 25B:
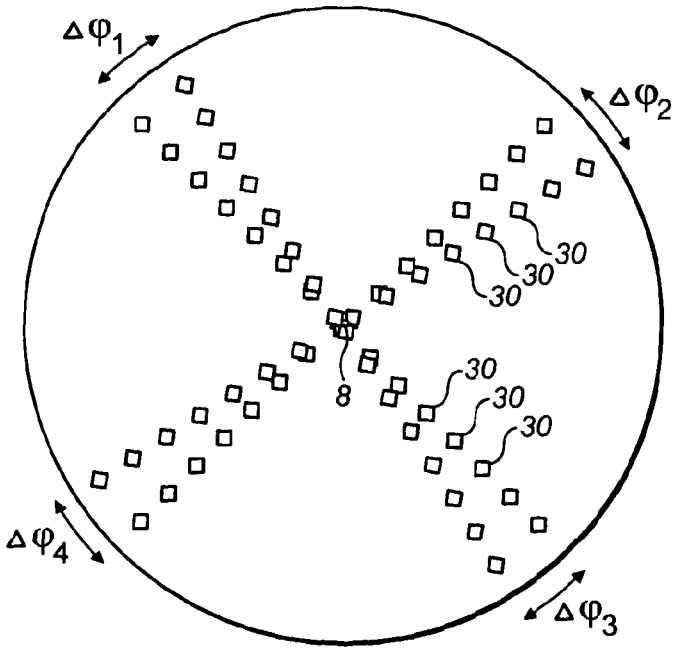
Figure 26:
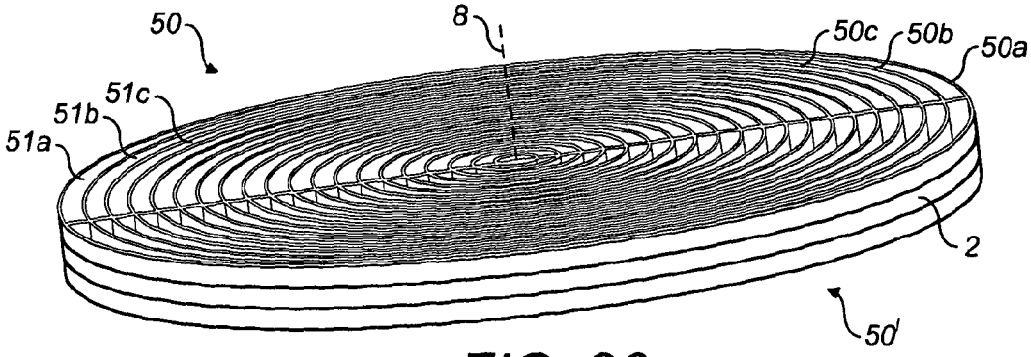
Figure 26A:
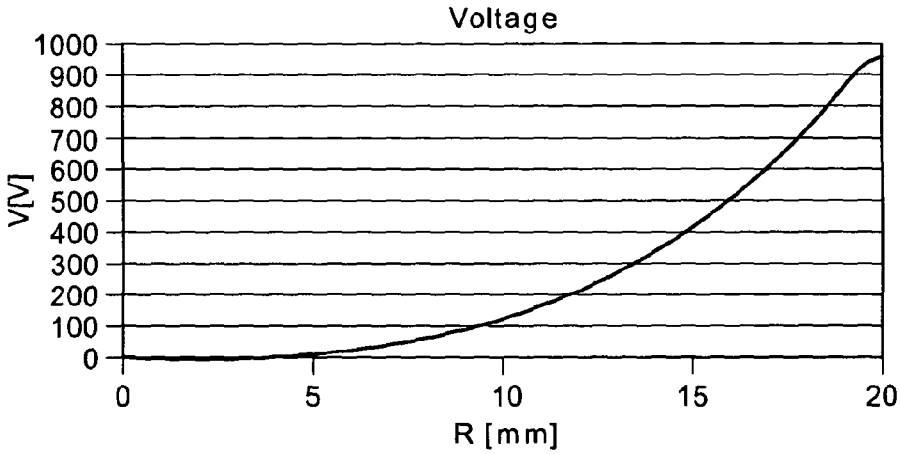
Figure 26B:
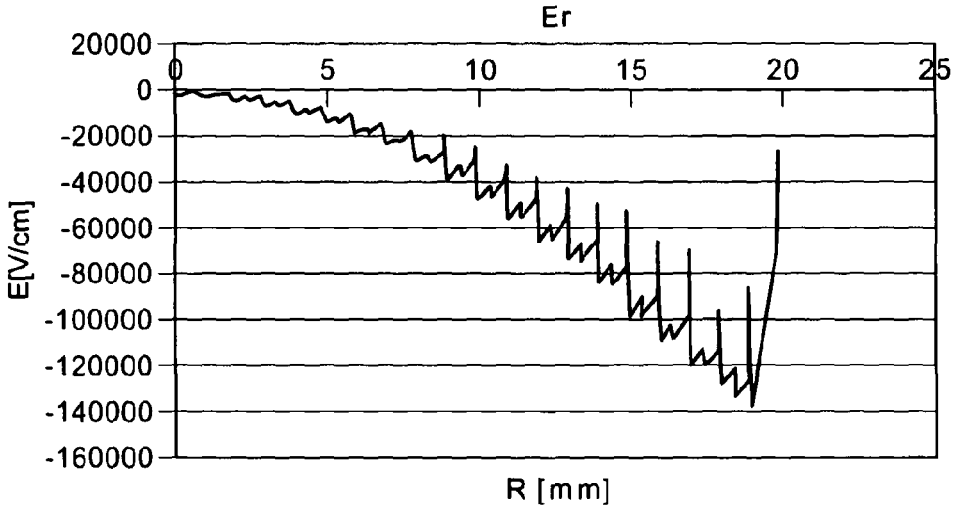
Figure 27A:
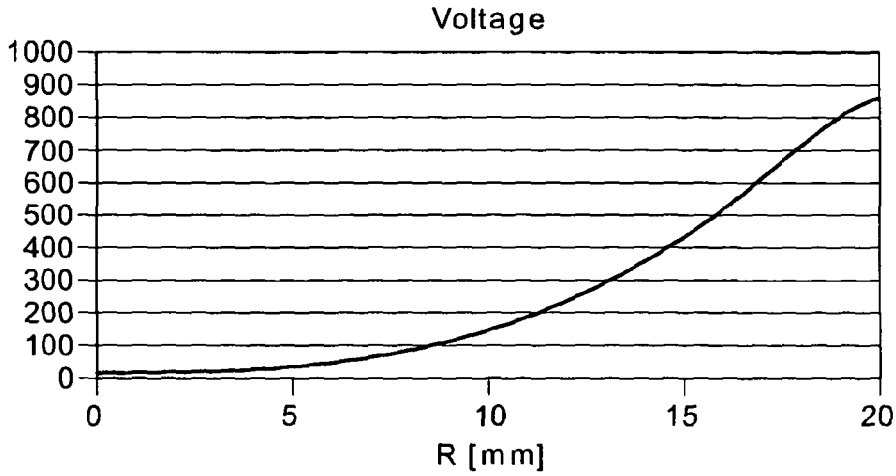
Figure 27B:
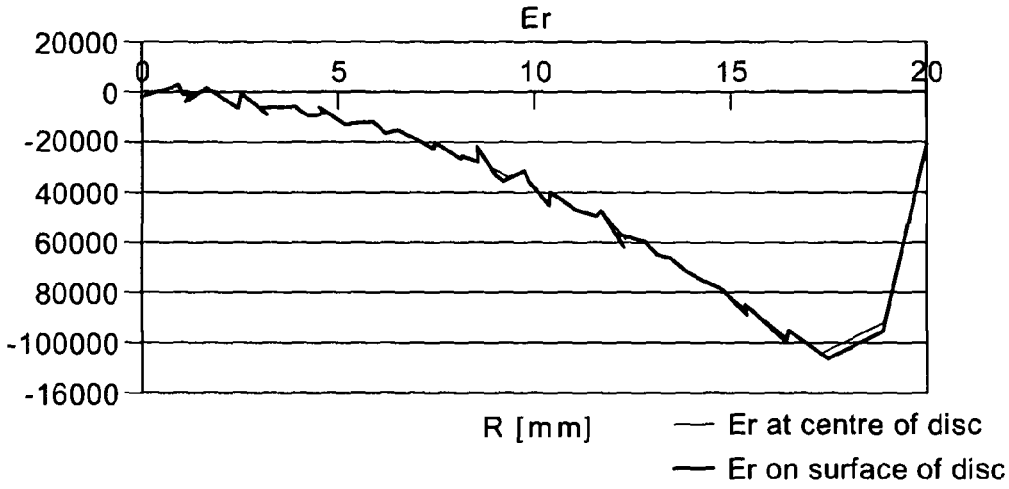
Figure 28:
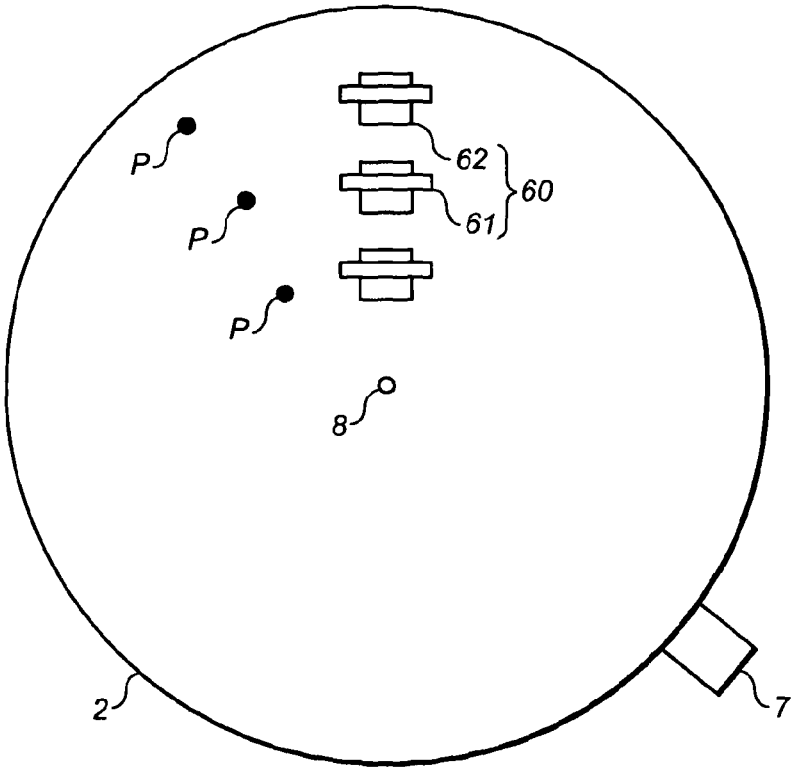

FIG. 11 is a plot showing radial forces acting on a particle in the first embodiment;

FIG. 12 illustrates radial oscillations of a particle in the first embodiment;

FIG. 13 illustrates angular oscillations of a particle in the first embodiment;

FIG. 14 illustrates radial and angular oscillations of a particle in the first embodiment;

FIG. 15 shows components of a detector in the first embodiment;

FIG. 15*a* shows an exemplary spectrum which may be generated by a processor based on signals from the detector of FIG. 15;

FIG. 16 schematically depicts components of a spectrometer according to a second embodiment;

FIG. 17 schematically depicts components of a spectrometer according to a third embodiment;

FIG. 18 is a plot showing a voltage profile with angular distance for the third embodiment;

FIGS. 19 and 20 show a voltage distribution used in a fourth embodiment, from two different aspects;

FIG. 21 schematically depicts components of a spectrometer according to a fifth embodiment;

FIG. 22 shows a voltage distribution used in the fifth embodiment;

FIGS. 23*a, b* and *c* show three exemplary electrode element arrangements;

FIGS. 24*a* and 24*b* show two examples of components of a sixth embodiment;

FIGS. 25*a* and 25*b* show two further examples of components of the sixth embodiment;

FIG. 26 shows components of a seventh embodiment;

FIGS. 26*a* and 26*b* are plots showing an exemplary radial voltage distribution and radial field applied using the embodiment of FIG. 26;

FIGS. 27*a* and 27*b* are plots showing an exemplary radial voltage distribution and radial field applied using a variant of the seventh embodiment; and FIG. 28 schematically depicts components of an alternative detector.

Figure 1:
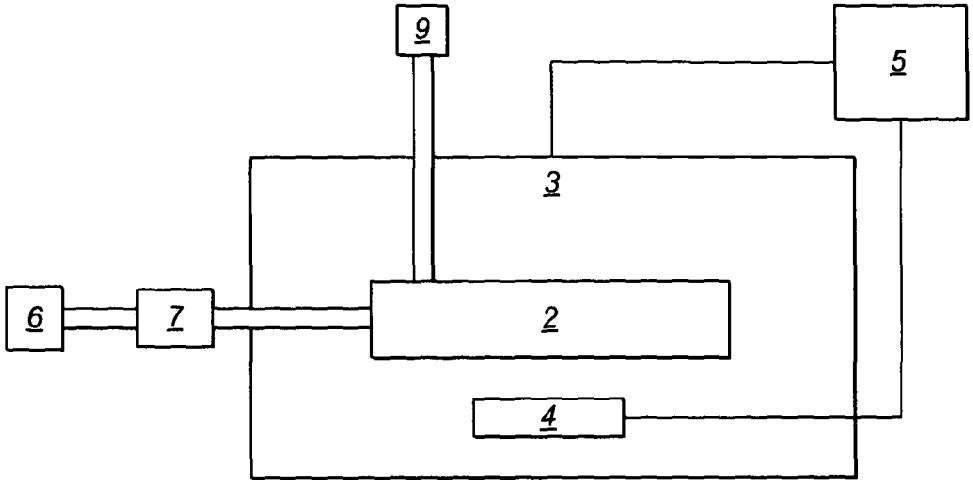
FIG. 1 is a schematic block diagram showing components of an exemplary spectrometer apparatus.

FIG. 1 schematically illustrates some of the main components of an exemplary spectrometer, suitable for implementing the embodiments discussed below. The mass spectrometer is indicated generally by the reference numeral 1. Field generating apparatus 3 is provided for generating one or more fields within a chamber 2. As will be detailed below, the field(s) generated are of such a type that they will act on charged particles within the chamber 2: for example, electric and/or magnetic field(s) will typically be appropriate and the field generating apparatus 3 will be configured accordingly. An injection device 7 is provided for injecting charged particles into the chamber 2. The injection device could receive charged particles from a source external to the spectrometer or, optionally, the spectrometer could include an ionisation device 6. Here, ionisation device 6 is fluidicly connected to the injection device 7 to enable the particles that have been charged by the ionisation device 6 to enter the chamber 2. The ionisation device 6 and injection device 7 could be formed integrally with one another or could be provided as two separate components.

In preferred implementations, the chamber 2 is maintained at a low gas pressure (an imperfect vacuum) and thus an evacuation device 9 such as a pump may be provided. This is not essential as will be explained below.

A detector 4 is provided for obtaining results from the chamber 2. This can take a variety of forms ranging from imaging of particles within the chamber 2 to extraction of particles from the chamber 2.

In most cases, the field generating apparatus 3 will be connected to a controller 5, such as a computer or other processor. The controller 5 can be used to control the size, shape, magnitude and direction of the fields created by the field generating apparatus 3. However, this can be excluded if the field shapes are not to be variable. The controller 5 may also be connected to the detector 4 in order to monitor and process the results obtained.

Each of the above mentioned components, as well as the operation of the spectrometer as a whole, will be described in more detail in the exemplary embodiments that follow.

Figure 2:
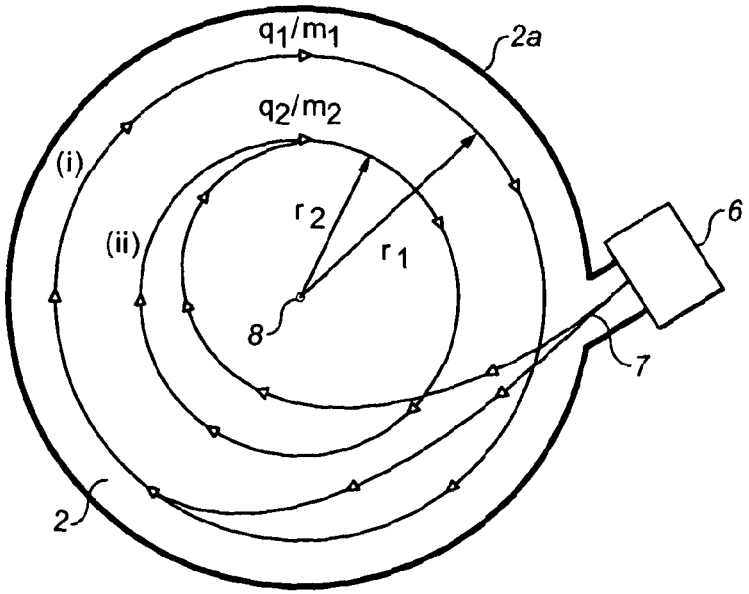
FIG. 2 is a plan view of a chamber and other components which may be used in the spectrometer of FIG. 1.

FIG. 2 shows an exemplary chamber 2 in plan view, which is suitable for use in the spectrometer. In this example, the chamber 2 is disc-shaped, having a circular cross-section and a low aspect ratio. For example, the diameter of the chamber may be of the order of 2 cm and its axial height may be around 0.5 cm. Any shape could be adopted for the chamber 2 although a substantially circular cross section is preferred: for instance, spherical, cylindrical or annular chambers could be employed. Circular cross sections are preferred because the particles will typically follow circular (or near circular, see FIGS. 24 and 25) orbits, and as such circular chambers are most space-efficient. However, the same orbits would be established in any shape of chamber, including cubic or rectangular chambers. In preferred cases, the chamber 2 is a vacuum chamber: that is, the chamber is hermetically sealable such that its interior atmosphere may be accurately controlled by a suitable control means such as the pump 9 previously described. The walls of the chamber 2 are preferably made from a material which does not tend to adsorb ions, or instead may be treated with a suitable coating such as a surfactant. In particularly preferred implementations, a small local repulsion is achieved at the chamber walls, for example by coating the walls with positive ions to repel positive charged particles (or vice versa). However this is not essential.

In this example, the ionisation device 6 and injection device 7 are located at an entry point on the periphery 2*a* of the chamber 2. In fact, the entry point could be provided anywhere on the surface of the chamber 2, including at the centre of the chamber (e.g. at or adjacent the rotation axis 8), or at any radial position between the rotation axis and the chamber periphery. The ionisation device 6 supplies charged particles to the injection device 7 for injection into the chamber 2. The precise velocity and direction of particle injection is not critical. Thus, the operation of the ionisation and injection devices is largely conventional.

Any suitable ionisation technique could be made use of. For example, electrospray ionisation (ESI) or matrix-assisted laser-desorption ionisation (MALDI) may be preferred for ionizing biomolecules in particular, since these are well known "soft" techniques which result in intact charged molecules. ESI uses a liquid phase analyte (e.g. a solution containing the sample) which is pumped through a spray needle towards a collector. A high potential difference is applied between the needle and the collector. Droplets expelled from the needle have a surface charge of the same polarity of that on the needle. As the droplets travel between the spray needle and the collector, the solvent evaporates. This leads to shrinking of each droplet until the surface tension can no longer sustain the applied charge (termed the Rayleigh limit), at which point the droplet explodes into multiple smaller droplets. This process repeats until individual charged molecules are left. ESI ionisation is particularly preferred (when sampling from a liquid phase) due to the small size of the ESI device. MALDI, on the other hand, makes use of a solid mixture of sample plus matrix which is dried on a metal target plate. A laser is used to vaporise the solid state material. Suitable ESI or MALDI apparatus is widely available. However, many other ionisation techniques are viable and may be preferred for specialised applications. For example, if the spectrometer is to sample from the ambient atmosphere, an air ionisation technique may be employed. These typically involve the provision of closely spaced electrodes with a voltage applied between them which is at or below the breakdown voltage of air, leading to appreciable ionisation without breakdown.

The injection device typically makes use of a linear particle accelerator, such as a charged plate surrounding an entry aperture or a series of spaced annular electrodes through which the particles are accelerated.

Figure 3:
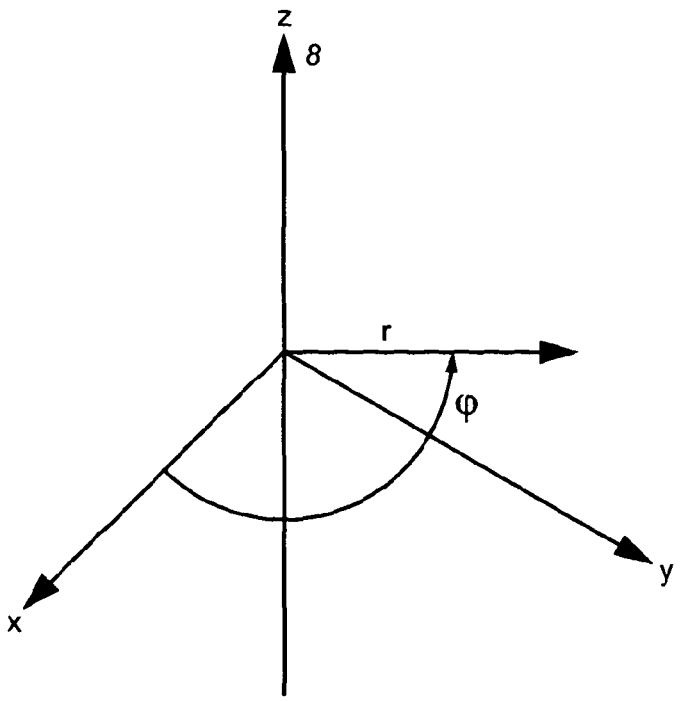
FIG. 3 illustrates directions as will be referred to in the text.

The field generating means 3 is arranged to establish one or more fields within the chamber 2. This can be achieved in a number of different ways but in each case an angular trapping field component and a radial balancing field component will be generated. These components can be generated independently of one another (i.e. by superimposing two or more separate fields) or can be provided by a single field. The angular trapping component acts angularly on charged particles within the chamber such that, under its influence, a particle will experience a force causing it to move along a circular path at a constant radius about a rotation axis 8, as depicted by the arrow $\phi$ in FIG. 3. FIG. 2 shows the rotation axis 8 aligning with the center point of chamber 2: this is preferred but is not essential. The radial balancing component acts perpendicularly to the angular component, along a radial direction between the rotation axis 8 and the periphery 2*a* of the chamber, as indicated by the arrow r in FIG. 3. In both cases it will be appreciated that the (angular or radial) direction in which the respective field component acts on a charged particle may not be parallel with the direction of the field component itself, as is the case for a magnetic field.

The angular trapping component is configured to include energy minima arranged to form one or more "channels" along which charged particles will be trapped, between the rotation axis 8 and the chamber periphery 2*a*. The manner in which this is achieved will be described further below. The field generating means is arranged to rotate the angular trapping component about the rotation axis 8 and the trapped particles will therefore likewise rotate about the axis such that each experiences a centrifugal force.

The radial balancing component is arranged to counter this centrifugal force. The trapped particles will therefore migrate along the channels established by the field under the influence of the centrifugal force and radial balancing field. The radial balancing field is shaped such that its magnitude increases monotonically with radial distance from the rotation axis 8. This enables the formation of stable equilibrium points along the channels at which a charged particle of a given charge to mass (q/m) ratio will settle. Since the angular trapping field continues to rotate, each settled particle will orbit around the rotation axis, and this is depicted for two different particle types by the traces (i) and (ii) in FIG. 2. The radius of each orbit is determined by the charge to mass ratio of the charged particle and thus particles with similar charge to mass ratios will settle on similar orbits within each of the channels. In FIG. 2, the outer particle orbit (i) with radius $r_1$ is formed of particles having a lower charge to mass ratio $q_1/m_1$ than those forming the inner particle orbit (ii) with lesser radius $r_2$. Thus, heavier, low charge particles will orbit at a greater radius than lighter, high charge particles. The orbits can be detected in a number of different ways as will be discussed below, the radius of each orbit providing information as to the mass (and charge) of the particles.

The strength of the radial and angular fields applied will depend on the particular application and can be selected from a broad range. In terms of the radial component, high q/m particles require a lower field strength than low q/m (heavy) particles. Any suitable field strength could therefore be applied but preferably not exceeding the breakdown threshold for the atmosphere within the chamber (if any). Typical field strengths are in the region of 1 kV/cm to 10 kV/cm but could be as high as around 40 kV/cm, which is approximately the upper limit for air before it will break down, according to the Paschen curve.

The angular field component may if desired be weaker than the radial field component since its role is to accelerate the particles to a certain angular velocity and is not required to balance a strong opposing force. In preferred cases the maximum angular field component at any one radius may be of the same order of the magnitude of the radial field component at that radius since this has been found to assist in trapping particles into each channel quickly. However, this is not essential.

Compared with conventional mass spectrometry techniques, the present device provides for high resolution analysis over a very large range of charge/mass ratios, which can itself be changed dynamically (on the fly) by adjusting the applied fields. As a result, both large and small particles can be analysed in a small, compact device. Conventional mass spectrometers are limited by a number of factors to analysing relatively low-mass particles, e.g. less than 20 kDa (kilo Dalton). This is due largely to loss of resolution for high mass particles. The present device on the other hand can operate well beyond the kDa region and up to the order of MDa, whilst achieving very high resolutions in a small volume, because unlike in conventional spectrometers, the particles are bound in closed trajectories that are highly focused, as described above. This allows for potentially large DNA molecules, proteins and even cells to be analysed. The device is equally well adapted to analyse small particles, such as inorganic chemicals.

Figure 4:
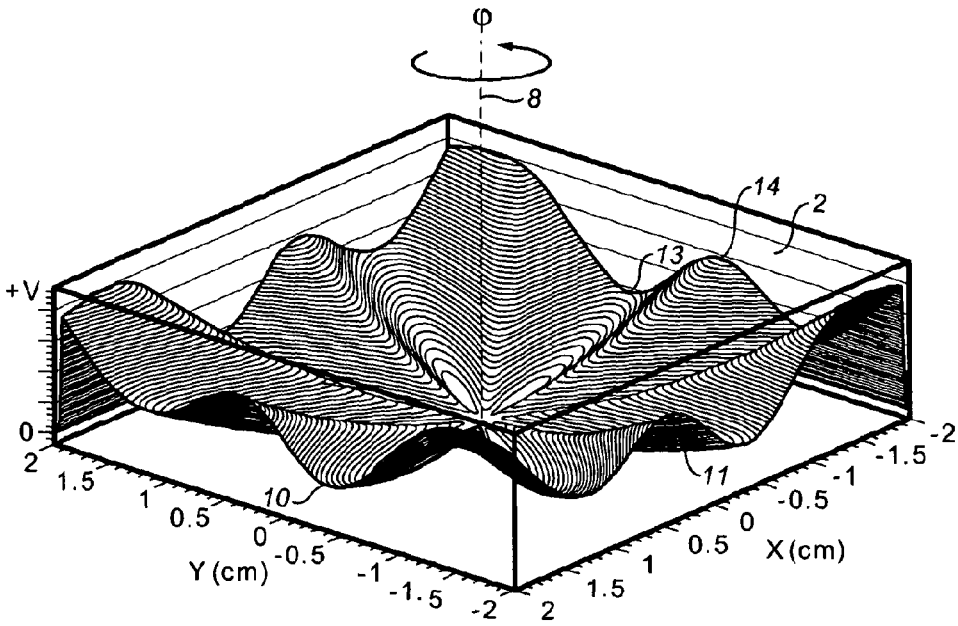
FIG. 4 shows an exemplary voltage distribution according to a first embodiment.

FIG. 4 is a schematic plot showing a voltage distribution applied to the chamber in a first embodiment of the present invention. In this embodiment, an electric angular trapping field and an electric radial balancing field are established separately from each other and superimposed resulting in the voltage distribution seen in FIG. 4. It will be seen that, in this example, the voltage follows a sinusoidal profile around the rotation axis 8. That is, at any one radial distance from the rotation axis 8, the angular profile of the voltage distribution is sinusoidal, resulting in a series of voltage troughs 10 and voltage peaks 11, at any one radius. The voltage peaks 10 and voltage troughs 11 represent points of minimum energy in the resulting electric field, as will now be demonstrated with reference to FIG. 5, which shows the relationship between the voltage applied and the resulting electric field along angular direction $\phi$. It should be noted that the angular trapping component need not be established throughout the whole chamber: for example, in the sixth embodiment described below, the trapping component is set up only in an angular subsection of the chamber.

As already noted, in this example, the voltage V has a sinusoidal profile and, since an electric field is proportional to the spatial derivative of a voltage distribution (i.e. $E=dV/d\phi$), the electric field E will also have a sinusoidal shape $\pi/2$ out of phase with the voltage (i.e. a cosine function of $\phi$, since $d/d\phi(\sin\phi)=\cos\phi$). Thus, the points of minimum electric field magnitude (which in this case is zero) correspond with peaks 11 and troughs 10 in the voltage distribution. As shown in FIG. 4, the voltage peaks and troughs at each radius are continuous in that each is arranged so as to align with those on adjacent radii, forming channels 13 and 14 between the rotation axis 8 and the chamber periphery. The channels 13 follow the "valleys" of the voltage profile whilst the channels 14 follow the "ridges". In this example, each channel 13, 14 extends the full distance between the rotation axis 8 and the chamber periphery but this is not essential.

Figure 5:
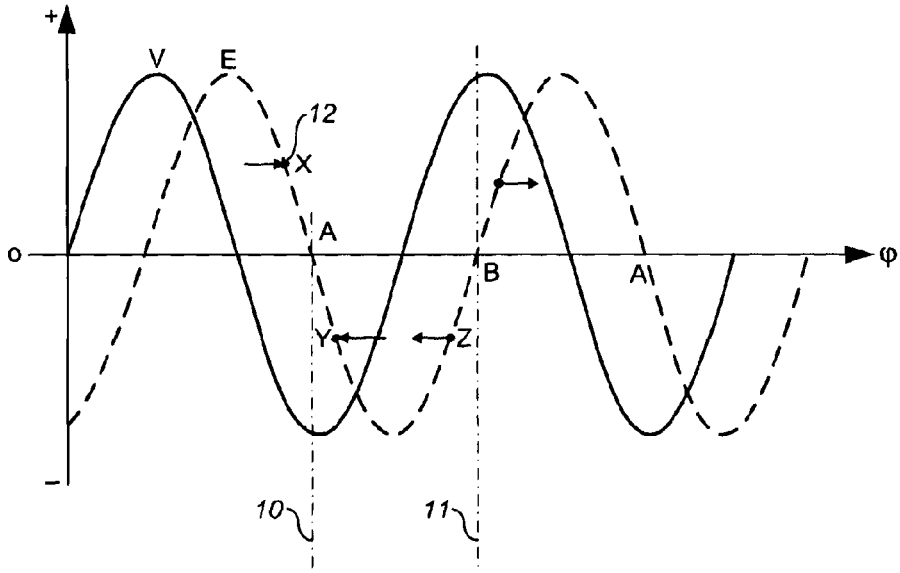
FIG. 5 shows plots of voltage and electric field with angular distance for the first embodiment.

Charged particles within the chamber 2 will migrate towards the channels 13 and/or 14 of energy minima under the influence of the angular trapping component. For example, FIG. 5 depicts a positive particle 12 in the vicinity of energy minima "A", corresponding to a trough 10 in the voltage distribution. In this example, the minima A is a zero-crossing point in the angular field: that is, to one (angular) side of the minima, the field is positive and on the other it is negative. In the sense of FIG. 5, a positive field component will cause a positive particle to move to the right of the Figure, whereas a negative field component will urge the positive particle left. Thus the positive particle 12 at position X will be urged to the right by the field, as indicated by the arrow. This will continue until the particle reaches the minima A where the electric field switches direction from positive to negative. If the positive particle 12 crosses the minima, it will now experience a force urging it to the left as indicated by the arrow on the particle in the negative electric field at position Y. Thus a positive particle will effectively be angularly trapped in the vicinity of minima A. In practice, the particle will continue to oscillate in this manner about the energy minima unless its motion is damped, as will be discussed below.

It will be noted from the graph of FIG. 5 that a further energy minima B exists, corresponding to a peak 11 in the voltage distribution. For a positive particle such as 12, this represents an unstable equilibrium position since the direction of the force experienced by the particle if it is displaced from the point B will be away from the minima. However, the opposite is true for negatively charged particles, which will find stable equilibrium positions on the voltage peaks and unstable equilibrium positions in the voltage troughs.

Zero-crossing points such as A and B above will exist in any alternating field where the sign of the field changes periodically about the rotation axis. Sinusoidal angular fields are preferred but triangular or square wave fields would be equally applicable. The provision of energy minima in the form of zero-crossing points of the field is preferred since, as demonstrated above, the trapping effect is particularly stable. However, this is not essential. For example, the fields on each side of a minimum could be of the same sign. Whilst this represents an unstable equilibrium position, provided the angular trapping component is rotating with sufficient angular velocity (faster than the particle can migrate away from the minima), the necessary trapping effect can still be achieved. Similarly, whilst it is advantageous if the magnitude of the field is zero at the minima, for the same reasons this need not be the case.

Thus, charged particles inside the chamber 2 are constrained along the channels 13 and/or 14 (depending on the particles' sign) formed by the energy minima of the angular trapping component, and rotate about the rotation axis due to the rotation of the angular trapping component.

Figure 6:
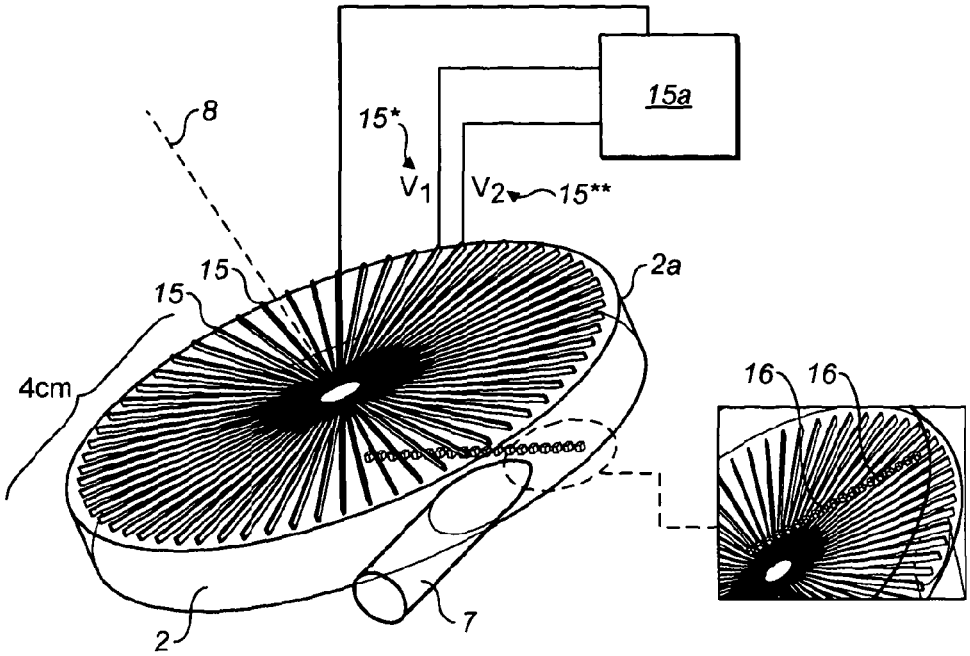
FIG. 6 illustrates components suitable for establishing an angular field component in the first embodiment.

FIG. 6 illustrates exemplary components of the field generating apparatus 3 which may be used to establish an angular trapping field of the sort described with respect to FIGS. 4 and 5. The chamber 2 is illustrated in perspective view and the injection device 7 is shown on the periphery 2*a* of the chamber as before. The field generating apparatus comprises an angular field electrode assembly in the form of a plurality of electrodes 15 (referred to as "trapping" electrodes since they perform the angular trapping of the particles) equally angularly spaced adjacent one surface of the chamber 2, preferably a surface perpendicular to the rotation axis 8. These could be disposed inside or outside the chamber 2. Any number of electrodes 15 could be used, although more than one is preferred. As described below with respect to FIGS. 24 and 25, the electrodes 15 need not be distributed across the whole surface of the chamber but could be arranged to cover only an angular subsection of the chamber.

Each electrode 15 extends between the rotation axis 8 and the periphery of the chamber 2. The electrodes 15 need not extend the whole distance from the rotation axis 8 to the periphery of the chamber 2, but only that portion where it is desired to establish the aforementioned channel(s). A voltage supply 15*a* is provided and a voltage is applied to each (or at least some of the) electrodes 15. For clarity, FIG. 6 shows only connections between two of the electrodes 15*, 15 and the voltage supply but in practice such connections will typically be provided for each electrode in the assembly. In this example, 0 volts is applied to the end of the electrodes 15 nearest the rotation axis 8. Voltages $V_1$, $V_2$, etc. are applied to the ends of the electrodes 15 near the periphery 2***a* of the chamber. Preferably, the electrodes are supplied with a "floating" voltage (i.e. the power supply applies a voltage difference between neighbouring electrodes rather than an absolute voltage, relative to ground), for reasons which will be discussed below. The voltage supply 15*a* is preferably under the control of processor 5 which sets the voltage level applied to each electrode to thereby establish the desired voltage distribution in the chamber 2. However, the voltage supply could perform this function itself. The angular profile of the field is set by careful selection of the voltage applied to each electrode, and to generate a sinusoidal angular field component of the sort discussed above, the voltage applied to each electrode will follow a sinusoidal distribution about the rotation axis. Other field shapes such as triangular or square wave profiles can be applied by appropriate selection of the voltage applied to each electrode.

Figure 7:
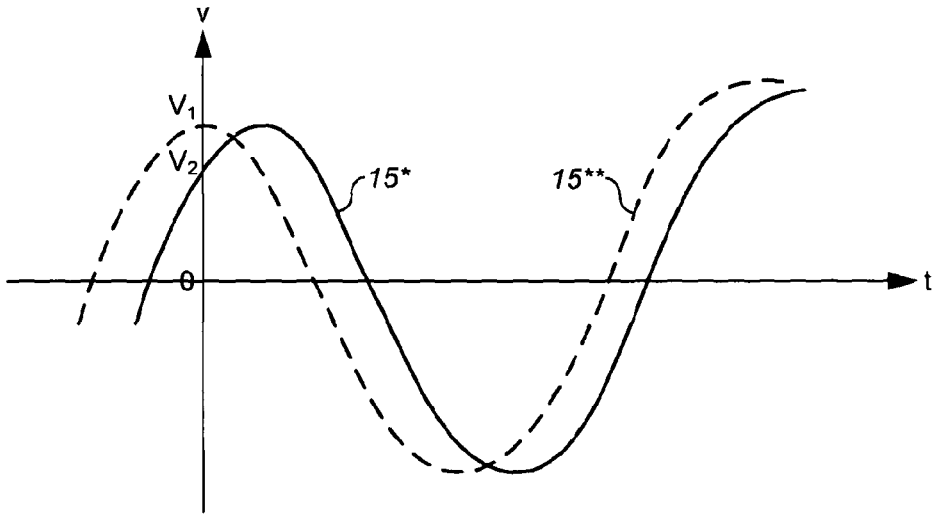
FIG. 7 is a plot of voltage applied to two exemplary electrodes, over time.

To rotate the angular field relative to the chamber 2, the voltage applied to each electrode 15 is preferably varied by the voltage supply 15*a* (or the controller 5) over time such that each applied voltage value progresses sequentially around the electrodes. The speed of rotation is controlled by the voltage supply or the controller. FIG. 7 shows the voltage applied to exemplary electrodes 15* (solid line) and 15 (dashed line) and its variation over time in the present example. It will be seen that at time=zero, electrode 15* is at voltage level $V_1$ whereas electrode 15** is at its maximum voltage $V_2$, representing a peak in the voltage distribution. The voltage on each electrode varies sinusoidally (or triangularly or otherwise) at a frequency directly related to the angular velocity of the angular field component. In FIG. 7, it can be seen that each electrode experiences a single voltage peak and single voltage trough in a time T. Since in this example there are 8 peaks and 8 troughs in the full voltage distribution (see FIG. 4**), this time T represents ⅛ of the time for the field to complete a full circuit. Thus the frequency of revolution, F, is given by 1/(8T) in this example. Typically, this will be of the order of kHz or MHz. The Angular velocity, ω, is given by 2πF.

The electrodes 15 are preferably made of a material having a non-zero resistance such as a resistive polymer or silicon, such that a potential difference is maintained along the radial direction between the rotation axis 8 and the periphery of the chamber 2. This leads to a voltage reduction towards the rotation axis which assists in the formation of an electric field which is continuous across the chamber, but this is not essential. However, this can lead to further advantageous implementations as will be discussed below. A further advantage of utilising resistive electrodes is that the current flow is minimised (or stopped completely), leading to a reduction in power consumption.

Figure 8:
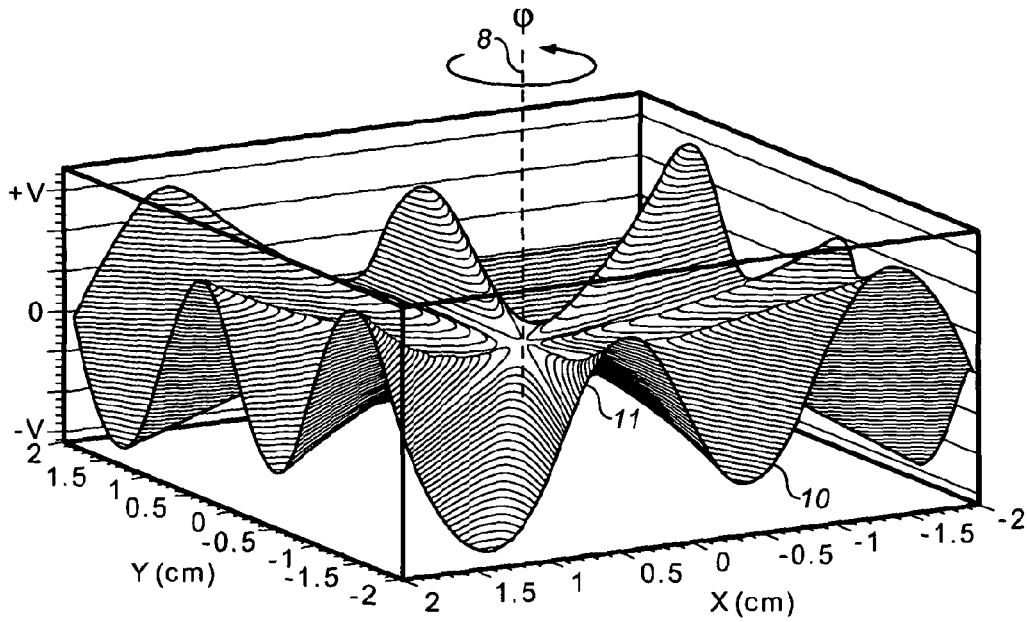
FIG. 8 depicts a voltage distribution which may be applied by the components shown in FIG. 6.

FIG. 8 shows schematically the shape of a voltage distribution which may be generated by the apparatus depicted in FIG. 5, and illustrates in particular the increasing amplitude of the sinusoidal angular trapping component with radius, due to the potential difference along each electrode as described above. A radial balancing field is added to this in order to arrive at the voltage distribution shown in FIG. 4.

Figure 9:
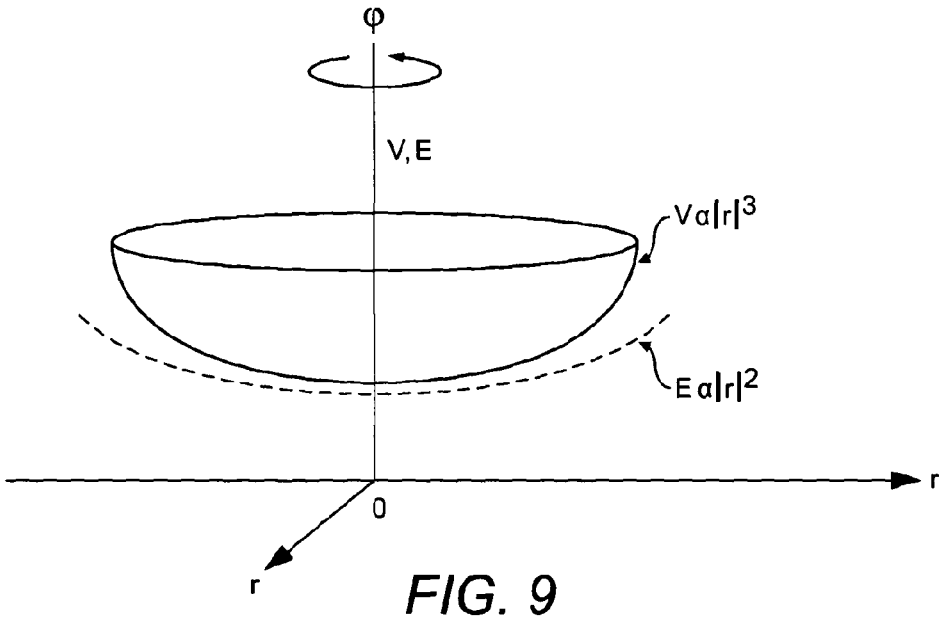
FIG. 9 shows exemplary voltage and electric field shapes of a radial balancing component.

FIG. 9 shows an exemplary voltage distribution V for the radial balancing component, and the resulting radial electric field E. In this example, the voltage increases as $r^3$ and has no ϕ dependence (i.e. is constant at one radius for all values of ϕ). The resulting radial electric field component therefore increases as $r^2$. In practice, the magnitude of the electric field component can take any monotonically increasing function of r in the region(s) corresponding to the one or more channels, since this will enable stable radial equilibrium positions as will be discussed further below. For example, the radial field magnitude may vary with $r^n$ where n is greater than or equal to 1 (though where n=1, the value of the electric field should be offset from zero at the rotation axis else the sole equilibrium point will coincide with the rotation axis).

Radial field shapes in which the field magnitude is constant at all angles at any one radius are preferred, but not essential. Since particles are confined to the angular field channels, this is where radial migration will occur. As such, the shape of the radial field away from the channels is not critical, and need not increase monotonically. However, where the applied radial field is not constant at any one radius, it should be rotated synchronously with the angular field in order that the necessary radial field shape is always aligned with the or each channel.

Superimposing a radial voltage distribution such as that shown in FIG. 9 on the angular distribution shown in FIG. 8 will result in a voltage distribution of the form shown in FIG. 4, having both radial and angular components.

FIG. 10 illustrates exemplary components of the field generating apparatus 3 for applying such a radial field, in the form of an electric field. The chamber 2 is shown from one side and the angular field electrode assembly comprising trapping electrodes 15 previously described with respect to FIG. 6 is depicted on the upper surface of the chamber 2. A radial field electrode assembly is additionally provided in the form of balancing electrodes 17*a* and 17*b*, one disposed on either side of the chamber (although a single such electrode could be deployed if preferred). Each balancing electrodes 17*a*, 17*b* is formed from a resistive material such as polymer or silicon as in the case of the angular trapping electrodes described above. Each of the balancing electrodes 17*a*, 17*b* has a thickness profile (in the axial direction of the chamber 2) which varies along the radial direction. Thus, in this example, the balancing electrodes are conical in shape having straight sides, but the sides of the cones could alternatively have a concave or convex surface profiles. The centre axis of the or each balancing electrode 17*a*, 17*b* is typically aligned with the rotation axis 8 of the angular field. The apex of each electrode can face towards or away from the chamber 2, but it is preferred that the electrodes are arranged as shown in FIG. 10 with each apex facing away from the chamber. Each balancing electrode 17*a*, 17*b* could be replaced with an array of radially positioned "wedge" shaped electrode elements if preferred.

A DC voltage is applied between the central axis of the balancing electrode and its circular periphery. In this example, the apex of each electrode is earthed whilst a positive voltage +V is applied to the periphery 18*a*, 18*b* of each electrode 17*a*, 17*b*. This can be achieved for example using a core contact piece 19*a*, 19*b* inserted into the apex of each cone, and an annular peripheral contact plate 20*a*, 20*b*. The core contact pieces 19*a*, 19*b* could, if desired, be replaced by a single core contact piece passing through the chamber (or through a gap in the chamber, where the chamber is annular) along the rotation axis 8, which can assist in field shaping. Since the electrodes 17*a*, 17*b* are fabricated from resistive material, a potential difference is created between the rotation axis 8 and the electrode periphery 18, which is shaped by the electrodes 17*a*, 17*b*, resulting in a radial voltage distribution within the chamber such as that described with respect to FIG. 9.

FIG. 10*a* is a vector plot from a finite element analysis showing the direction of an electric field produced using the above described apparatus. Here, the balancing electrodes 17*a*, 17*b* and chamber 2 are viewed from one side. Other components are not illustrated for clarity. The arrows depict the strength (arrow length) and direction of the electric field at each point in the vicinity of the balancing electrodes and it will be seen that between the electrodes, within the chamber 2, the field is radial (i.e. perpendicular to the rotation axis). The voltage distribution along a radius of the chamber 2 for an exemplary case in which a voltage of +1000 V is applied to the electrode peripheries and the apex is earthed (0V) is shown in FIG. 10*b*. FIG. 10*c* shows the corresponding radial electric field and it will be seen that this increases in magnitude (negatively) with increasing radius in a monotonic, non-linear manner as is desirable.

The angular and radial field components thus generated can be added to one another in a variety of ways. As already mentioned, the angular component can be generated by a dedicated power supply separate from the DC power supply for the radial component. If so, then the trapping electrodes should "float" on the applied radial voltage, i.e. the voltage applied to the trapping electrodes should preferably be in the form of a voltage difference applied between neighbours and not an absolute voltage, relative to ground, which would grossly distort the radial voltage distribution. By causing the trapping electrodes to "float", the voltage at each trapping electrode will be the sum of the radial voltage and the angular voltage. Another way to achieve this is to bias the trapping electrodes by electrical contact with the balancing electrodes, via suitable resistors or resistive material. Alternatively, it is possible to use a non-floating power supply if it is arranged to apply an absolute voltage V+dV where V is the radial voltage and dV the angular voltage. This may be appropriate in latter implementations, to be discussed below.

Once the angular and radial fields are superimposed on one another, the resulting voltage distribution will be the sum of the two voltages at any point within the chamber, which is shown in FIG. 4. As previously mentioned, the radial field may be of significantly greater magnitude than the angular field component, and this enables the radial field shape to dominate such that the direction of the radial field can be imposed as necessary. For example, it will be noted from FIG. 8 that in the angular field alone, the troughs extend to voltages which are negative relative to that at the rotation axis 8, whereas the peaks extend to voltages which are positive relative to that at the rotation axis. Thus there will be an inherent radial field component which acts towards the rotation axis along the peaks, but towards the periphery on the troughs. By adding a strong radial field in the manner described above, this can be manipulated such that radial forces act in the same direction at all points of the field. This is the case in FIG. 4 from which it will be noted that both the channels formed by the peaks and those by the troughs extend to voltages higher than that at the rotation axis 8, such that the radial field acts inwardly at all points. Alternative configurations also have benefits, which will be discussed below.

In the exemplary case depicted in FIG. 4, the final voltage distribution is of the form $V=A(r/R)^3+B(r/R)\sin(N\phi+\omega t)$ where A and B are constants, r is the radial co-ordinate, $\phi$ is the angular co-ordinate, t is the time co-ordinate, R is the desired radial extent of the field (e.g. the radius of the chamber), N is the number of wavelengths of the angular component contained in one full circuit about the rotation axis, and $\omega$ is the angular velocity at which the angular component is rotated. In this example, N=8 which means that 8 voltage troughs and 8 voltage peaks are contained within each circuit, corresponding to 16 channels of which half will provide stable "traps" for any given particle. Thus, N could take any value and although it is preferred that an integer number of wavelengths is provided, this is not essential. The larger the value of N, the greater the number of available channels which reduces problems associated with self-repulsion between like particles since fewer particles will be trapped in any one channel.

The particles trapped in any one channel migrate along the channel under the combined influence of the radial field component and the centrifugal force. As discussed above, the force experienced by a particle due to the radial field component is arranged to act inwardly so as to counter the outward centrifugal force. Thus, where positively charged particles are to be analysed, voltage distributions of the sort shown in FIG. 4 (where the voltage is always more negative towards the rotation axis than at the periphery) are appropriate. Where negative particles are to be analysed, the opposite should be applied. The magnitude of the radial field will still vary monotonically in the same manner as discussed above, regardless of its direction. In certain embodiments, both positive and negative particles can be analysed simultaneously and this option will be returned to below.

FIG. 11 shows the radial forces on an exemplary particle in a channel. The centrifugal force $F_C$ on the particle always acts outwardly (to the right of FIG. 11) and is proportional to $m\omega^2 r$, where m is the mass of the particle, ω its angular velocity and r is the radial position. The force due to the radial field component acts inwardly and, in this example, is proportional to $qr^2$, where q is the charge on the particle and r is the radial position. As shown in FIG. 11 for every q/m ratio, there will be a radial position r* at which the forces $F_C$ and $F_R$ are equal and opposite. By arranging the radial field magnitude to increase monotonically with r (e.g. with $r^2$, as shown here), this will lead to the point r* forming a stable equilibrium position. A particle fluctuating away from r* towards the rotation axis (to the left in FIG. 11) will enter a region where $F_C > F_R$ such that the net force is outward, urging the particle back towards r*. Likewise, if the particle moves past r* towards the chamber periphery (to the right in FIG. 11), it will experience a net inward force and once again is urged toward r*.

Thus particles will settle at equilibrium radii r* according to their charge to mass (q/m) ratios. Particles having like q/m ratios will bunch together around r*. The bunches of like particles will orbit the rotation axis as the angular component rotates.

As alluded to above, particles will tend to oscillate about their equilibrium positions. This occurs both angularly (about the angular energy minima, i.e. the "virtual" channels) and radially (about the equilibrium points r*). This oscillation may not be problematic if the fields are arranged such that the particles are localised within a sufficiently small volume. For example, if the voltage troughs forming channels 13 are sufficiently steep-sided, positive particles will effectively oscillate within a narrow potential well. Similarly, the shape of the applied radial field can also be controlled to minimise radial oscillations. However, to improve the resolution of the device, it is preferred that particle oscillation is damped, and this is advantageously achieved by maintaining the interior of the chamber at a controlled gas pressure and temperature, preferably an imperfect vacuum. This provides a degree of friction which opposes self motion of the particles whilst not significantly inhibiting their movement under the influence of the applied fields, as well as the added benefit that there is no requirement for a pump capable of producing a true vacuum, which are typically bulky and would thus reduce the mobility of the device.

Various different gases may be selected for this purpose. Factors which should be taken into consideration include:

- the breakdown voltage of the gas—typically, applied electric field strengths will be high (in the region of 10 to 50 kV/cm) in order to achieve excellent resolution. As such it is preferable to select a so-called dielectric gas such as air, nitrogen, argon/oxygen, xenon, hydrogen or sulphur hexafluoride (possibly mixed with a noble gas)). Many other suitable dielectric gases are known.
- the damping effect of the gas—different gases will have different effects on ion mobility.
- chemical inertness of the gas.

Xenon has been found to provide a suitable combination of properties, although many other gases (single species or mixtures) could also be used.

The appropriate gas pressure will also depend on various factors, including the nature of the particles under test and the necessary applied field strengths. For instance, in many cases a low pressure will provide the necessary balance of damping self-oscillation whilst not inhibiting the particles' trajectories. However, in other cases a higher pressure may be necessary to avoid breakdown of the gas due to the applied fields. This may be the case, for example, where massive particles such as cells are to be analysed at relatively low angular velocity and high radial field strengths (necessary since, even at low velocities, massive particles will experience a correspondingly high centrifugal force). The Paschen curve indicates that the breakdown voltage of air will increase with increasing pressure.

The friction provided by the gas damps oscillations such that the particles lose energy and settle in the vicinity of the relevant field equilibrium point. The point at which each particle eventually settles may not precisely coincide with the equilibrium point as will be demonstrated below. However any such displacement is typically negligible compared to the radius of the orbits and so has little effect on the results obtained. The displacement can also be factored into processing of the results if desired.

In the example which follows, several simplifications are made in order to linearise the equations and derive an analytical solution that will quantify the kinematical characteristics of the charged particles around the equilibrium condition. For the radial electric field component, a linear shape (i.e. $E \propto r$) is assumed. Likewise, it is assumed that the angular field component approximates to a linear field in the vicinity of the equilibrium point (see FIG. 5).

Thus, the angular field component is of the form:

$$E_\phi(\phi)=A(\phi-\omega t)+B \tag{1}$$

where A and B are constants. The radial field component takes the form:

$$E_r(r)=-Cr-D \tag{2}$$

where C and D are constants. The negative sign preceding C means that the field will be negative, i.e. acting inwardly on a positive particle. The centrifugal force on a particle is given by:

$$F_\omega(r)=m\omega^2 r \tag{3}$$

The following dynamic equations can therefore be written. In the radial direction:

$$mr''(t)+m\omega^2 r(t)+q\,E_r(r)+\rho r'(t)=0 \tag{4}$$

where m is the mass of the particle, q is the charge on the particle and ρ is the friction co-efficient due to the controlled pressure of gas within the chamber. The notation ' is used in the conventional manner to indicate derivates. In the angular direction:

$$m''(t)-qE_\phi(\phi)(t)+\rho\phi'(t)=0 \tag{5}$$

Substituting the field shapes into equations (4) and (5) and solving the differential equations for bound states gives the following equations of motion. In the radial direction:

$$r(t)=-\frac{Dq}{Cq-m\omega^2}+e^{-\frac{\rho t}{2m}}\left(r_0+\frac{Dq}{Cq-m\omega^2}\right)\cos\left(\frac{t\sqrt{-\rho^2+4m(Cq+m\omega^2)}}{2m}\right) \tag{6}$$

In the angular direction:

$$\Phi(t) = \frac{-Bq + \rho\omega r}{Aq} + r\omega t + 2e^{-\frac{\rho t}{2m}}\left(\Phi_0 - \frac{-Bq + \rho r\omega}{Aq} - r\omega t\right)\cos\left(\frac{\sqrt{-\rho^2 - 4Amqt}}{2m}\right) \quad (7)$$

Thus, as $t \to \infty$, the particles tend towards equilibrium points given by:

$$r^* = -\frac{Dq}{Cq - m\omega^2} \quad (8)$$

and $$\Phi^* = \frac{-Bq + \rho\omega r}{Aq} + r\omega t \quad (9)$$

It should be noted that here $\phi$ is a measure of distance in the angular direction and not the angular subtended.

The frequencies of oscillation around the equilibrium position, $f_r$ and $f_\phi$ (which should not be confused with the frequency F of the rotation of the angular field), are given by:

$$f_r = \frac{\sqrt{-\rho^2 + 4m(Cq + m\omega^2)}}{4\pi m} \quad (10)$$

and $$f_\Phi = \frac{\sqrt{-\rho^2 - 4Amq}}{4\pi m} \quad (11)$$

An example will now be illustrated with reference to FIGS. 12, 13 and 14. The following parameters are assumed:

Frequency of rotation, F ($=\omega/2\pi$)=100 kHz

Friction coefficient, $\rho=1\times10^{-19}$ N s/m

Particle mass, m=50 kDa (1 Dalton=1 unified atomic mass unit)

Particle charge, q=+1

Initial radius, $r_0$=1 cm

Initial radial position, $\phi_0$=0 radians $A=-2\times10^6$

B=0

$C=2\times10^7$ $D=5\times10^3$

FIG. 12 shows the oscillation about the equilibrium radius (represented by r=0) for a time period of just over 0.0005 seconds. It will be seen that the oscillations are damped, such that by t=0.0005 s the particle has more or less settled on the equilibrium radius. FIG. 13 shows the angular oscillation over the same time period extending to t=0.001 s. Here, the equilibrium point is constantly moving due to the rotation of the angular field component and this leads to the displacement of the particle away from "zero" position over time. Nonetheless, by t=0.001 s, the oscillations have been reduced to near zero amplitude. FIG. 14 shows the oscillations in 2D, effectively combining FIGS. 12 and 13, for the period up to t=0.001 s. The uppermost point of the plot represents the settled particle with its oscillation damped to near zero.

In implementations which include damping such as that described above, it is preferable that the maximum angular field at each radius is sufficient to overcome the damping effect. In other words, where damping is provided by a gas, the force on a particle due to the (maximum) angular field should preferably be greater than any frictional force between the particles and the gas at the angular velocity $\omega$. This has been found to assist in retaining particles within each channel but is not essential.

The orbits established by the particles can be detected in a number of different ways. In the present example, the detector 4 comprises an array of radiation detecting elements 16 which are visible in FIG. 6. The elements 16 could be arranged within the chamber 2 or the chamber wall could be radiation transparent at least in the region of each element 16. Any number of such elements 16 could be provided. Each element is a photodetector, such as a CCD, which generates a signal upon receipt of radiation. The output from each element is connected to a processor, such as controller 5.

Particles within the chamber 2 will tend to absorb radiation or otherwise obstruct its passage through the chamber and as such the intensity of received radiation will be reduced at elements 16 adjacent the particle orbits. Ambient radiation could be used for this purpose but in preferred examples, the detector 4 may additionally comprise a radiation emitter **16*a* (i.e. a light source) for emitting radiation to be received by the detection elements 16**. By providing a dedicated radiation source and tuning the detector elements accordingly, interference effects from ambient radiation sources can be reduced. Any type of radiation could be selected, visible or otherwise, but ultraviolet radiation is preferred.

The radiation intensity received by each detector element 16 can be used to determine the location of the particle orbits and also the density of the particles in each of the particle orbits.

FIG. 15 shows the detector assembly in more detail. Here, a line of detector elements 16 extends along a radial path between the rotation axis 8 and the chamber periphery on the underside of the chamber 2. A radiation emitter **16*a* is arranged on the opposite side of the chamber although this could be arranged elsewhere if the chamber walls are wholly transparent. The emitted radiation R passes through the interior of the chamber 2 and is partially transmitted to the detection elements 16, depending on the location and density of the particle orbits P within chamber 2. The intensity signals are transmitted to a processor which, in this example, generates a spectrum as illustrated in FIG. 15*a***. Each peak in the spectrum represents a different particle orbit, the radius of which is determined by the particles' mass and charge. The radius of each orbit can therefore be measured and used to calculate the mass of the particles forming the orbit. Preferred ionisation techniques such as MALDI generate particles with single or double charges (e.g. +1, −1, +2, −2) and so the charge on each particle will generally be straightforward to deduce. Other techniques such as ESI may generate a multitude of higher ionisation states, in which case appropriate software may be used to deduce charges and masses from the detected orbits. In some cases, the ionisation device may produce ions of the same substance but with different charges, in which case more than one orbit will be formed for the substance. Commonly, however, a substance will have a propensity towards one particular charge level and so the majority of like particles will settle on a single orbit.

Other detection techniques will be discussed below.

The above embodiment makes use of two electric fields to manipulate the particles. However, other approaches are also viable. In a second embodiment, the radial balancing component is provided by a magnetic field whilst the angular trapping component is electric and produced in the same manner as described above. The use of a magnetic field can be advantageous since this is often more straightforward to implement than the radial electric field described above. However, it is difficult to generate very high strength magnetic fields. Nonetheless, magnetic implementations are useful for analysing high charge to mass ratio particles.

FIG. 16 illustrates components of the field generating apparatus 3 which may be used to apply a magnetic radial field. Here, the chamber is disposed between two poles 24, 25 of a magnet assembly 21. For clarity, the chamber 2 is shown enlarged and thus extends beyond the cavity between the magnetic poles, but in practice this will generally not be the case, in order that the resulting magnetic field B is orientated substantially parallel to the rotation axis 8 across the whole chamber 2. Any suitable magnet could be used, but preferably an electromagnet is employed, having a "C" shaped core 22 and coil 23 through which a current flows to induce the magnetic field. This can be controlled by processor 5.

In order to provide the desired monotonically increasing field shape, each pole 24, 25 has a surface profile which extends further toward the chamber 2 at the periphery than at the rotation axis. For instance, in the present embodiment, the surface of each pole 24, 25 is concave and this is represented by the dashed lines in FIG. 16. The poles are preferably centered on the rotation axis 8 such that their deepest point coincides with the rotation axis 8. Thus, here the magnetic field strength between the poles is at a minimum due to the increased spacing of the two poles. The magnetic field strength increases towards the periphery of the chamber as the poles' surfaces approach one another. The magnetic field strength profile will be determined by the shape of the poles' surfaces, which can be configured as desired. In this case, the result is a symmetrical magnetic field aligned with the rotation axis 8 within the chamber 2, having a field strength which increases with radial distance from the axis 8 in a manner similar to the electric radial field profile described above with respect to FIG. 9. In this case, the magnetic field strength increases with $r^n$ where n is greater than 1, e.g. $r^2$ or $r^3$. It would also be possible to use a magnetic field whose magnitude increases linearly with radius but this would require the magnetic field minimum to be offset from the rotation axis since otherwise the magnetic radial force and the centrifugal force would balance only at r=0 (for all particles). A non-linear monotonically increasing magnetic field is therefore preferred. As previously discussed, many other radial field shapes are possible and the field need not be rotationally symmetric, in which case it is preferably rotated in sync with the angular field.

The so-produced magnetic field acts on charged particles moving within the chamber 2 by virtue of their constituting an electric current. Since the particles' motion is angular (due to the rotation of the trapping field), the force due to the magnetic field is radial ($F_B$=q(v×B), the Lorentz force) and can therefore be arranged to counter the centrifugal force on the particles in place of the electric radial field used in the first embodiment. The angular trapping field, meanwhile, is produced in precisely the same way as in the first embodiment and hence an angular field electrode assembly 15 and power supply is provided as previously described. Since the application of the magnetic field will not distort the electric angular trapping field, the voltage distribution within chamber 2 remains of the form depicted in FIG. 8 (assuming a sinusoidal profile is selected). Thus, the applied magnetic field must be of sufficient strength to overcome the radial electric field, which will act outwardly in some sectors (i.e. the net radial force on a particle should be magnetic).

Particles will therefore settle along the channels formed of angular minima, as before, and migrate along the channels under the influence of the centrifugal and radial (magnetic and electric) field forces to form particle orbits as before. Particle oscillation will preferably be damped using a controlled pressure of gas, as above. The orbits can be detected using detection elements 16 in the same manner as previously described.

Similarly shaped magnet fields could be established in other examples using concentric magnets of varying strength to form each pole 24, 25 rather than shaping the poles' surfaces.

In the two above embodiments, the angular trapping component and radial balancing component are each generated separately and superimposed on one another. This has advantages in that each field component may be varied independently of the other. However, in a third embodiment both field components are generated together using a single set of electrodes. This simplifies the construction of the field generating apparatus but requires a more complex field profile.

The angular field electrode assembly already described with respect to FIG. 6 could be used to form a field with both radial and angular components. Indeed, this is already the case due to the potential difference between the end of each electrode adjacent the rotation axis 8 and that adjacent the chamber periphery. However, this relies on the resistance of the electrode material alone and in practice further control of the radial field shape is desirable to achieve a monotonically increasing radial component. FIG. 17 illustrates a third embodiment of the invention in which an array of electrode elements is disposed across one surface of the chamber 2, which here is of an annular form. Here, the electrode elements 30*a*, 30*b* etc are arranged in radial lines 30 effectively forming a set of equally angularly spaced linear electrodes as before. By forming each as an array of electrode elements, the voltage distribution can be controlled radially as well as angularly by controlling the voltage level applied to each element individually. Thus a voltage supply 35 is provided and arranged to apply voltages to each of the electrode elements 35*a*, 35*b* etc. As before, the applied voltages may be controlled by the voltage supply 35 itself or by connection to the controller 5, and each applied voltage is varied with time so as to rotate the field. In this case, the voltage applied to each element is V+dV, where V is the radial voltage and dV the angular component.

In other examples, control of the radial field could be achieved by appropriate profiling of the electrodes. For example, an array such as that already shown in FIG. 6 could be modified such that the thickness of each electrode 15 (parallel to the rotation axis 8) increases towards the rotation axis 8. The profile of the electrodes will determine the radial field shape in a manner similar to that described with respect to the balancing electrode assembly of FIG. 10.

A detector 4 comprising an array of detection elements 16 is also provided in a similar manner to the previous embodiments, although in this case the detection elements cover the surface of the chamber in much the same pattern as the depicted electrode element array 30. This has advantages since the radius of each orbit can be measured at multiple points leading to more accurate results. As an extension of this, a grid of detector elements could be provided over the whole surface of the chamber such that the whole orbit will be imaged. This has the advantage that the detector need not be accurately positioned relative to the rotation axis, since the radius can be determined from measurement of the orbit's diameter. A similar result may be obtained by the use of two linear arrays of detection elements which intersect one another, preferably at the rotation axis: a circular orbit will thus be detected at four points and its dimensions determined without reference to the rotation axis position.

As has already been described, a voltage distribution of the form shown in FIG. 8 could be formed using a single electrode assembly such as now described. However, as alluded to above, here the radial field switches direction around the rotation axis: in the region of the troughs, the radial field will be positive (i.e. orientated from + to − from the rotation axis towards the periphery), whereas in the region of the peaks, the radial field will have the opposite orientation. Since positive particles will migrate angularly to the troughs and negative particles to the peaks (see the discussion of FIG. 5, above), this has the result that, on all angularly trapped particles, the radial force will act outwardly and as such cannot counter the centrifugal force. Such a configuration will not be capable of producing the desired particle orbits.

To overcome this problem, a voltage distribution of the form shown schematically in FIG. 18 may be used. This plot shows a portion of the voltage profile along an angular distance D, at a constant radius from the rotation axis 8. Each voltage peak 40 is provided with a "secondary" trough 41 and likewise each voltage trough 42 is provided with a "secondary" peak 43. The secondary peaks 43 follow the radial curvature of the valleys 42 in which they lie and the secondary troughs 41 likewise follow the radial curvature of the primary peaks 40. Positive particles finding secondary troughs 41 will be confined therein in much the same manner as previously described and likewise negative particles will be trapped along secondary peaks 43. Thus (positive) particles confined in secondary troughs 41 and (negative) particles confined in secondary peaks 43 will each experience a radial force of the correct sign, acting radially inward and thus countering the centrifugal force to allow orbits to form. As such, this implementation has the additional benefit that particles of both signs may be analysed simultaneously, made possible by the radial field having opposite directions in different sectors of the chamber. Nonetheless, this configuration will be prone to sample loss since any particles not initially in the vicinity of a secondary trough or peak will migrate (angularly) away and towards a region in which the radial field will act on them outwardly, causing such particles to impact the periphery of the chamber.

A fourth embodiment making use of an alternative implementation for analysing positive and negative particles simultaneously is depicted in FIGS. 19 and 20. The apparatus used to apply the electric field is much the same as that discussed with respect to FIG. 17, with the voltage applied to each electrode element modulated accordingly. It will be seen that in one half the field, the radial field will be oriented towards the rotation axis, whereas in the other half, the direction of the radial field is reversed. A field of this type can be described by the equation $V(r,\phi)=A\, r^3/R^3\, \mathrm{Sign}(N\phi)+B\, r/R\, \sin(N\phi)^2$ where "Sign" means + or −1, depending on the sign of $N\phi$. In this example, the angle $\phi$ is taken to go from $-\pi$ to $+\pi$.

As in the previous embodiments, positive particles will migrate to voltage troughs and negative particles to voltage peaks. However, all positive particles in the negative portion of the field (the left hand region of FIG. 20) will experience an outward radial force and hence be lost. The same will occur to negative particles in the positive field region. As a result, approximately half the sample can be expected to be lost. However, this is likely to be less than in the case of the FIG. 18 embodiment.

It will be appreciated that many different field shapes can be designed having sectors of opposite radial field sign in order to analyse positive and negative particles in this way.

All of the embodiments described above have made use of straight, radial channels along which the particles are angularly constrained. However, this need not be the case and indeed in many cases it is advantageous to make use of alternative channel shapes. A fifth embodiment, of which the chamber 2 and its angular field electrode assembly are shown in FIG. 21, makes use of arcuate channels. This has the benefit of increasing the length of each channel without requiring an increase in the radius of the chamber 2. A greater number of orbits can therefore be formed within each channel.

The trapping electrodes 15' are configured in much the same way as described with reference to FIG. 6, although here each electrode 15' is curved and follows an arcuate path between the rotation axis and the periphery. Voltages are applied to each electrode 15' by a voltage supply 15*a* as before, and varied sequentially to rotate the field.

An exemplary voltage distribution produced by this arrangement in combination with a radial component applied for example using the apparatus of FIG. 10, is shown in FIG. 22. The voltage distribution may be described by $V(r,\phi)=A\, r^3/R^3+B\, r/R\, \sin(\phi N+kr/R)$. It will be noted that the peaks and troughs of the voltage distribution each follow tessellating arcuate paths determined by the shape of the electrodes 15'. Particles are confined to the peaks or troughs (depending on their sign) in precisely the same manner as previously described. The particles move along the arcuate channels under the influence of the centrifugal force and radial field in much the same manner as before, although now their path is additionally influenced by the angular field component. The particles will therefore follow the arcuate path of the channel in coming to settle at their radial equilibrium positions. The resulting orbits can be detected using the same techniques as previously described.

Figure 23B:
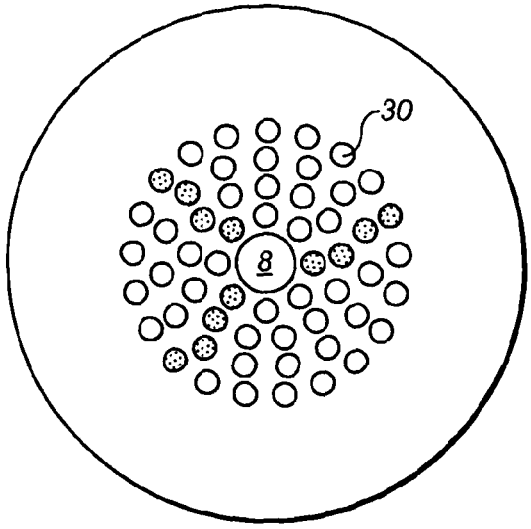
Figure 23C:
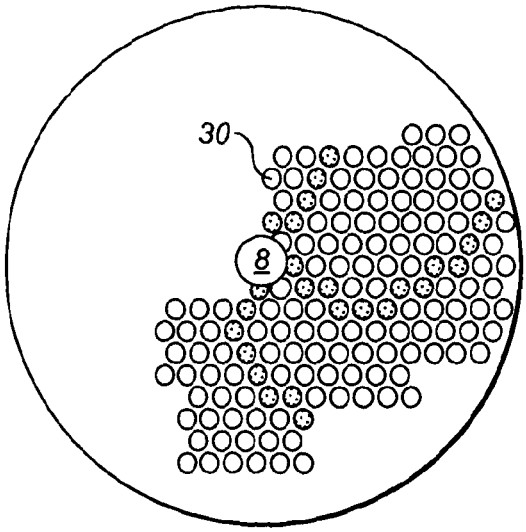

In order that the shape of the channels is not constrained by that of the electrodes 15 or 15', in one particularly preferred embodiment, the electrodes are formed of a 2D grid of electrode elements 30 disposed across the surface (or at least a portion of the surface) of the chamber 2. Examples of such grids are shown in FIGS. 23*a, b* and *c*, which each depict an exemplary disc-shaped chamber 2 in plan view and a portion of the elements 30 disposed on each. In FIG. 23*a*, the elements 30 are arranged in an orthogonal grid pattern, in FIG. 23*b*, the elements 30 are disposed about a series of concentric circles, and in FIG. 23*c*, the elements 30 are arranged in a hexagonal close packed lattice. The desired field shape can then be implemented by applying appropriate voltages to some or all of the elements. To illustrate this, the shaded elements 30 in each of FIGS. 23*a, b* and *c* represent the elements to which peak voltages are applied at any one instant in three exemplary cases. In FIG. 23*a*, straight radial channels are produced, whereas in each of FIGS. 23*b* and 23*c*, arcuate channels are implemented. Of course, any channel shape could be formed using any of the electrode arrangements shown.

As noted above, a long channel length is preferred since this allows for many q/m ratio particles to find equilibrium positions within the device. As such, the channels will preferably extend the whole distance between the rotation axis and the chamber periphery. However, this is not essential and the channels could extend for only a portion of that distance if desired, ending short of the rotation axis and/or short of the chamber periphery.

As mentioned above, the trapping electrodes do not need to cover the whole chamber and need not cover it in a symmetrical way. In particular, the angular trapping field can be established using electrodes disposed only across an angular subsection of the chamber, and a sixth embodiment of the spectrometer in which this is implemented will now be described. FIG. 24*a* shows relevant components of the sixth embodiment for applying the angular field: other components such as those for establishing the radial balancing field are not shown for clarity, and can be implemented as discussed in the preceding embodiments.

By limiting the area of the chamber 2 which is provided with trapping electrodes, the number of trapping electrodes required can be reduced, bringing about an associated cost reduction and simplifying manufacture. In addition, implementations such as these may be advantageous where it is desired to place some other device on the same chamber surface as the electrodes (e.g. a detector, injection device or extraction mechanism), which may require an electrode-free area.

In the example of FIG. 24*a*, only two trapping electrodes 15' and 15" are provided, which between them define a subsection 35 of the chamber 2 of angular extent $\Delta\phi$. Additional electrodes 15 could be deployed in the subsection 35 if desired, but two is the minimum required. Each of the trapping electrodes 15 extends between the rotation axis 8 and the chamber periphery as discussed above (particularly in relation to FIGS. 6 and 21), and can be implemented and controlled using the same techniques.

The subsection 35 of electrodes establishes a subsection of the angular trapping field within the chamber. The particular characteristics of the angular field can be selected as desired, and can correspond, for example, to any of the field shapes discussed above. The only difference is that the field is only created within the subsection of the chamber defined by the electrodes, rather than surrounding the rotation axis 8 completely: this is analogous to masking a portion of the angular field in the previous embodiments. The voltages on each electrode 15', 15" are controlled in the same way as previously described such that the angular field within the subsection rotates about axis 8 in the same manner as before.

As the injected ions cross the subsection 35, they are urged towards the virtual "channel" established by the angular field in the same manner as described with respect to FIG. 5, and as such are accelerated by the rotation of the field, just as if the field had been present throughout the whole chamber. However, once the ions exit the subsection 35 (after an angular distance of $\Delta\phi$), they will experience a slight deceleration due to the absence of the rotating field and the effects of friction (discussed above in relation to FIGS. 12 to 14). This causes the path of the ions to deviate slightly, resulting in an orbit which is not precisely circular, as indicated by the path P shown in FIG. 24*a*. When the ions reach the subsection 35 once again, they experience a further acceleration by the angular field, and the cycle is repeated. Overall, the net effect is very similar to that obtained in the preceding embodiments, save for the particle orbits being slightly non-circular.

It should be appreciated that, in this embodiment, the particles are confined along virtual "channels" in the trapping field in the same way as previously described, even though the field itself is not present at all points of rotation and only acts on the particles for a fraction of each orbit. Consider first a hypothetical scenario where there is no friction: in the subsection 35, the angular field is rotating with angular velocity $\omega$. A particle in that subsection will migrate angularly towards the minimum energy position (the virtual "channel") and ultimately will be accelerated to match the angular velocity $\omega$. At the same time, the particle is migrating radially under the influences of circumferential force and the applied radial balancing field, towards an equilibrium radius, $r^*$. Assuming the particle has reached equilibrium conditions by the time it exits the subsection 35, then in the absence of any friction, the particle will continue around a circular orbit at velocity $\omega r^*$, and on completion of the orbit, will re-enter the subsection 35 in sync with the angular field.

In practice, the particle will experience friction, causing it to decelerate once it exits the subsection 35. As a result, it will travel the orbit at a slightly reduced velocity ($\omega r^*-dv$), and it will re-enter the subsection 35 at a slightly reduced radius ($r^*-dr$). Since, at the point of re-entry, the particle will slightly lag behind its intended angular position, it will also slightly lag behind the phase of the angular field in the subsection. As a result, the particle will experience a larger angular force urging it towards the virtual "channel", and hence a greater angular acceleration tending to bring the particle back to angular velocity $\omega$, in sync with the rotating field. Essentially, the subsection of the field will attempt to restore the particle to its equilibrium conditions. In practice, the end result is that the particle will not completely settle at equilibrium, but will perform a mildly non-circular trajectory around the ideal circular orbit. The continuous accelerate-decelerate cycle keeps the particle's angular velocity at $\omega$ on average and ultimately the particles will migrate to form orbits of like particles which can be detected and/or collected using the same techniques as previously described.

Exactly the same principles can be applied using trapping electrodes in the form of electrode elements, and an example implemented in this way is shown in FIG. 24*b*. Here, the same subsection 35 is defined by two trapping electrode element arrays 30' and 30", each comprising a number of electrode elements 30'*a*, 30'*b*, etc. To achieve the necessary field shaping, at least two electrode elements should be provided at each radial position (e.g. 30'*b* and 30"*b*). Further elements could be provided at each radial position if desired.

The subsection 35 can cover any portion of the chamber 2, and more than one subsection may be provided if desired. In general, the electrode subsections should be configured to ensure that there is adequate angular field coverage around the chamber to preserve the trajectory of the particles with sufficient accuracy, which will depend on the particular operating conditions. For example, FIG. 25*a* shows an example in which electrode elements 30 cover the majority of the chamber, leaving only a small segment in which the angular field will not be established. FIG. 25*b* shows another example in which four subsections are provided, enabling the particles to be accelerated four times on each orbit. Here, each subsection is shown to be of the same angular extent, but different values of $\Delta\phi_1$, $\Delta\phi_2$, $\Delta\phi_3$ and $\Delta\phi_4$ could be implemented if preferred.

In implementing embodiments such as those shown in FIGS. 24 and 25, it is necessary to specify the particle injection parameters more precisely than in other embodiments. This is because the discontinuity in the angular acceleration increases the sensitivity of the system to the injection velocity. For example, if the particles are injected with a velocity which differs greatly from that of the rotating field, it becomes difficult for the particles to fall in sync with the subsection in which the field is present and in the worst case, the particles may never reach equilibrium conditions. As such it is preferable in the sixth embodiment to configure the system to inject the particles with a velocity close to $\omega r_{inj}$ (where $r_{inj}$ is the radial position of the injection device). In general, however, the injection system should ensure that at least some of the particles can reach equilibrium conditions.

Components of a seventh embodiment of the spectrometer are shown in FIG. 26. This embodiment makes use of inductive means for applying a radial balancing field, rather than the conductive implementations discussed above. As mentioned previously it is advantageous to use electrodes made of a material having a finite resistance to reduce currents and hence power consumption. By utilising an inductive arrangement as in the present embodiment power consumption is reduced still further.

In this embodiment, the radial balancing field electrode assembly comprises a dense series of coaxial ring electrodes 50, of which three exemplary ring electrodes 50*a*, 50*b* and 50*c* are labeled in FIG. 26. The electrodes 50 are insulated from each other by a suitable dielectric (gas, liquid or solid) in the regions 51*a*, 51*b*, 51*c* etc. Here, the electrodes 50 are formed of a good conductor such as metal. Symmetrical sets of ring electrodes 50 are arranged on each side of the chamber 2: in FIG. 26, the underneath set of electrodes is indicated generally by 50'. A suitable DC voltage distribution is applied using a power supply (not shown). In an exemplary case, each electrode carries a voltage between 0V (at the innermost ring electrode) and 1000V (at the outermost ring electrode), with a voltage step between each which is proportional to $r^3$ (where r is the radial distance from the rotation axis 8). The angular field component can be applied using any of the techniques described in previous embodiments: the components for doing so are not shown in FIG. 26, for clarity, but would typically include trapping electrodes arranged between the balancing electrode assembly 50 and the chamber 2. Each trapping electrode or trapping electrode element may be electrically connected to an adjacent ring electrode 50 via a resistor or suitable resistive material to arrange for the voltage on the trapping electrode to "float" on the radial voltage as described in previous embodiments.

The radial voltage distribution resulting from the ring electrodes 50 within the chamber 2 is shown in FIG. 26*a* and is seen to be smooth. However, the corresponding electric field distribution on the same radial line is found to exhibit a stepwise behaviour, as depicted in FIG. 26*b*. The sharp spikes in the field can be smoothed out by spacing the ring electrode assembly 50 further away in the z-direction (parallel to the rotation axis) from the chamber 2. The remaining stepwise behaviour can be mitigated by increasing the number of electrodes and making each as thin as possible. This is achievable as the electrodes 50 can be deposited lithographically as densely as desired: indeed, the whole construction including a detector could potentially be done in a single silicon chip. However in the preferred configuration a plastic chamber 2 is envisaged with metal electrodes 50 deposited on either side, using any suitable method, including lithography, other etching methods, electroplating etc. The resulting smoothed field provides the desired monotonic increase for balancing the centrifugal force on the particles.

The stepwise behaviour observed is due to the combination of an increasing voltage line density towards the rotation axis (due to the ever decreasing radius of the ring electrodes) and an opposing applied voltage distribution. The increase in voltage line density leads to an increase in field intensity towards the centre of the chamber. The voltage distribution is imposed using the dense array of electrodes 50 in order to reverse the direction of this increase in field intensity, so as to obtain the necessary monotonic increase with radius. As a result, the electric field follows the imposed voltage levels from electrode to electrode on average, but in the space between the electrodes, the influence of the increased voltage line density at the centre of the chamber becomes evident and reduces the field strength locally, resulting in the stepwise effect seen.

The "step" features have advantages and disadvantages. The advantage is that they can act as traps to digitally define discrete equilibrium points along the radius and thus increase the precision of the instrument in some circumstances. The disadvantage is that only as many particle species can be resolved as there are steps, at any one time. However, by increasing the number of electrodes 50 and using moderate smoothing (by spacing the electrodes a away from the chamber), the steps can be effectively eliminated. For instance, FIGS. 27*a* and 27*b* show voltage and electric field curves for a modified version of the seventh embodiment in which the thickness of each electrode 50*a*, 50*b*, 50*c* is reduced to 10 microns and the electrode plane is spaced from the chamber by 0.5 mm. It will be seen that the electric field at the centre of the chamber follows a substantially smooth curve.

The primary advantage of such an inductive configuration is that no electric current flows in the electrodes and thus the power consumption is minimal. This is because the entirety of each ring electrode is held at a single potential, such that no current will flow around the ring, and because there is no electric current between the ring electrodes. If the ring electrodes are electrically connected to the trapping electrodes (as mentioned above), the configuration becomes a hybrid conductive/inductive system since there will be a small current in the resistors. However, this will be minimal. The present arrangement also provides additional benefits, in that it is light and can occupy less volume than other examples, enhancing the portability of the device.

In the embodiments above, the detector 4 is arranged so as to enable a measurement of an orbit's radius to be made. This is often desirable but alternative approaches may be preferred, depending on the application of the device. For instance, instead of providing detector elements along a whole radius, a single detection element could be provided at a single predetermined radius. This could correspond to a radius at which a particle of known q/m ratio is expected to settle. Alternatively, it could be an arbitrary (but known) radius, and during operation, the radial field component is varied so as to change the radial equilibrium position r* for each particle type. In this way, an orbit can be "shifted" to the position of the detector and the field adjustment necessary to achieve this can be used to determine the particles' mass. A large q/m range can be scanned in this manner. Many other configurations are also possible.

In another implementation, rather than image particles within the chamber 2, the detector could be arranged to extract particles from one or more orbits. This not only provides confirmation as to the radius of a particle's orbit but also enables collection of the particle itself. FIG. 28 shows schematically an example of such a detector, in the form of a collection device 60, that could be used. The chamber 2 is shown in plan view although the collection device 60 could equally be disposed on its underside. One or more exit points 62 are provided in the chamber wall, at predetermined radial distances from the rotation axis 8. Outside the chamber and adjacent each exit point 62 is an exit electrode 61. As before, the predetermined radii may be fixed to correspond to the equilibrium points of known particles P, or the orbital radii could be adjusted by the controller during operation such that particles of a desired type orbit at the predetermined radii. To extract the particles on a given orbit, a high voltage of appropriate sign is applied to the exit electrode 61 such that charged particles P are accelerated toward the exit electrode 61. The so-extracted particles can be thus be collected and deionised if desired, for example by dissolution in a suitable buffer.

If desired, a single such device could be provided to perform both the above described extraction and double as injection device 7.

The flexibility of the spectrometer leads to its use in a wide number of applications. In terms of sampling, the mass spectrometer can be used, for example, to capture air born agents or it could be attached to a liquid phase device where suspended macromolecules are ionised using ESI or MALDI techniques. As an example, in the field of biological analysis, proteins (or DNA) may be extracted from a subject under test, digested (broken down) and injected into the spectrometer for analysis. It is also conceivable that the mass spectrometer could be combined with a microfluidic device to perform a full cycle of analysis (separation, digestion, mass spectrometry) in a small benchtop or portable device. In addition the device can be used for field applications to detect and analyse air born agents on the battlefield, installed in military vehicles or even as an accessory carried by personnel. It can be installed in airports and other public places to detect terrorist threats.

Considering some exemplary applications in more detail, as will be appreciated from the discussion above, one of the primary uses of the spectrometer is to separate samples of mixed particles. Particles of different q/m ratios will separate onto orbits of different radii and can thus be distinguished. Information such as the mass of each particle type can be gathered from the orbital radii as previously described. This in turn permits compositional analysis of the particle. Relative concentrations of each particle type in the mixed sample can also be deduced by comparing the density of particles on each orbit. Techniques of this sort find application, for example, in DNA analysis amongst many other uses.

Of course, the spectrometer need not be used with mixed particle samples but could be used for laboratory analysis of individual particle types, to determine mass and composition for example.

The spectrometer can also operate as a substance detector. For example, the detector could be set to recognise orbits at a predetermined radius as corresponding to a particular known substance, for example by programming the processor 5 accordingly. The presence of an orbit at that radius could be used to trigger an alarm. Thus, the device could be arranged to sample from the ambient atmosphere and produce an alarm in response to the presence of contaminants, such as toxic gases or pollutants such as dust or soot particles. The compact nature of the device lends itself to being deployed in a portable monitoring device, which may even be worn by a user. Alternatively, the spectrometer could be used to analyse samples taken from particular environments, such as luggage in airports or packages in customs facilities. In such cases, the spectrometer may be configured to respond to substances such as known explosives or drugs.

In a final example, where the detector comprises a collection device, the spectrometer can be used to purify substances or to extract one material from a compound. For instance, where a sample of mixed particle types is injected, particles settling on a single orbit may be extracted as described with reference to FIG. 26. If desired, this could be performed continuously by continuously injecting the mixed sample into the chamber and performing continuous extraction at a predetermined radius. Alternatively a predetermined sequence of injection/extraction pulses could be implemented. In addition to straightforward purification, which is vital to many industries, this technique finds use in many applications since it is often the case in drug development and indeed any research application that, after a molecule's mass has been determined, further analysis may be needed to determine its chemical reactivity or other characteristics. The extracted particles of known type or mass can thus be directly transferred from the chamber and into another device for performing such further tests. In view of the examples given above, it will be appreciated that the spectrometer can be implemented in a wide variety of ways and used in many diverse applications.

The invention claimed is:

1. A mass spectrometer comprising:

a chamber;

an injection device adapted to inject charged particles into the chamber;

field generating apparatus adapted to establish:

at least one field acting on the charged particles, the at least one field having:

an angular trapping component configured to form at least one channel between a rotation axis and the periphery of the chamber, the at least one channel being defined by energy minima of the angular trapping component, the field generating apparatus being further adapted to rotate the angular trapping component about the rotation axis, whereby in use charged particles are angularly constrained along the at least one channel by the angular trapping component to rotate therewith, a centrifugal force thereby acting on the charged particles;

and a radial balancing component having a magnitude increasing monotonically with increasing radius from the rotation axis, at least in the vicinity of the at least one channel, whereby in use charged particles move along the at least one channel under the combined influence of the centrifugal force and the radial balancing component to form one or more particle orbits according to the charge to mass ratios of the particles; and a detector configured to detect at least one of the particle orbits.

2. A mass spectrometer according to claim 1 wherein the angular trapping component is provided by an angular trapping field, and the radial balancing component is provided by a radial balancing field or the radial balancing component is a component of the angular trapping field.

3. A mass spectrometer according to claim 2, wherein the angular trapping field is an electric field.

4. A mass spectrometer according to claim 3, wherein the field generating apparatus comprises an angular field electrode assembly, the angular field electrode assembly comprising a plurality of trapping electrodes or trapping electrode elements and a voltage supply arranged to apply a voltage to at least some of the trapping electrodes or trapping electrode elements.

5. A mass spectrometer according to claim 4, wherein the angular field electrode assembly comprises at least two trapping electrodes extending between the rotation axis and the periphery of the chamber, the trapping electrodes preferably being substantially equally angularly spaced about the rotation axis.

6. A mass spectrometer according to claim 4, wherein the angular field electrode assembly comprises at least two arrays of trapping electrode elements, each array extending along a respective path between the rotation axis and the periphery of the chamber, the arrays preferably being substantially equally angularly spaced about the rotation axis.

7. A mass spectrometer according to claim 4, wherein the angular field electrode assembly comprises a two dimensional array of trapping electrode elements disposed between the rotation axis and the periphery of the chamber, the trapping electrode elements preferably being arranged in an orthogonal grid pattern, a hexagonal grid pattern, a close-packed pattern or a concentric circle pattern.

8. A mass spectrometer according to claim 4, wherein the or each trapping electrode or trapping electrode element comprises resistive polymer or silicon.

9. A mass spectrometer according to claim 3, where the radial balancing component is a component of the angular trapping field, wherein the angular field electrode assembly is configured such that the voltage on the or each trapping electrode or on an array of trapping electrode elements varies between the end of the or each trapping electrode or array towards the rotation axis and the end of the or each trapping electrode towards the periphery of the chamber so as to establish a monotonically increasing radial field.

10. A mass spectrometer according to claim 2, wherein the radial balancing field is a magnetic field.

11. A mass spectrometer according to claim 10, wherein the field generating apparatus comprises a magnet assembly arranged such that the chamber is disposed between opposing magnetic poles of the magnet assembly.

12. A mass spectrometer according to claim 2, wherein the radial balancing field is an electric field.

13. A mass spectrometer according to claim 12, wherein the field generating apparatus comprises a radial field electrode assembly comprising at least one balancing electrode disposed adjacent the chamber having a radial profile shaped so as to establish a monotonically increasing radial field when a voltage is applied thereto.

14. A mass spectrometer according to claim 12, wherein the field generating apparatus comprises a radial field electrode assembly having a plurality of annular electrodes arranged in concentricity with the rotation axis and spaced from one another by dielectric material, and a voltage supply arranged to apply a voltage to each of the annular electrodes.

15. A mass spectrometer according to claim 1, wherein the energy minima correspond to points of substantially zero angular trapping component magnitude, preferably zero-crossing points at which the angular trapping component has a first direction on one side of the zero-crossing point, and a second direction opposite to the first on the other side of the zero-crossing point.

16. A mass spectrometer according to claim 1 wherein the field generating apparatus is adapted to establish the angular trapping component only in an angular subsection of the chamber defined about the rotation axis.

17. A mass spectrometer according to claim 1, wherein the radial balancing component has a first direction in at least one first angular sector of the chamber, and a second direction opposite to the first direction in at least one second angular sector, the first and second angular sectors corresponding to first and second channels of angular minima.

18. A mass spectrometer according to claim 1, wherein the detector is one of:

a detector adapted to measure the radius of at least one of the orbits of particles;

a detector adapted to detect a particle orbit at one or more predetermined radii; or a detector comprising a collection device adapted to collect charged particles from one or more particle orbits.

19. A method of mass spectrometry, comprising:

injecting charged particles into a chamber;

establishing at least one field acting on the charged particles, the at least one field having:

an angular trapping component configured to form at least one channel between a rotation axis and the periphery of the chamber, the at least one channel being defined by energy minima of the angular trapping component, and a radial balancing component having a magnitude increasing monotonically with increasing radius from the rotation axis, at least in the vicinity of the at least one channel;

rotating the angular trapping component about the rotation axis, whereby charged particles, angularly constrained along the at least one channel by the angular trapping component, rotate therewith such that a centrifugal force acts on the charged particles, the charged particles moving along the at least one channel under the combined influence of the centrifugal force and the radial balancing component to form one or more particle orbits according to the charge to mass ratios of the particles; and detecting at least one of the particle orbits.

20. A method of mass spectrometry according to claim 19, wherein the angular trapping component is provided by an angular trapping field, and the radial balancing component is provided by a radial balancing field, or the radial balancing component is a component of the angular trapping field.

21. A method of mass spectrometry according to claim 20, wherein the radial balancing field is a magnetic field.

22. A method of mass spectrometry according to claim 20, wherein the radial balancing field is an electric field.

23. A method of mass spectrometry according to claim 19, wherein the angular trapping component is established only in an angular subsection of the chamber defined about the rotation axis.

24. A method of mass spectrometry according to claim 19, wherein the angular trapping field is an electric field.

25. A method of mass spectrometry according to claim 19, wherein the magnitude and/or shape of the radial balancing component is varied during movement of the charged particles so as to adjust the radii of the or each particle orbits.

26. A method of measuring the mass of a charged particle, comprising injecting a sample of charged particles into a chamber, performing the method of claim 25, wherein the step of detecting comprises measuring the radius of at least one of the particle orbits, and calculating the mass of the particle(s) based on the at least one measured radius.

27. A method of mass spectrometry according to claim 19, wherein the step of detecting comprises one of:

measuring the radius of at least one of the particle orbits;

detecting particles at one or more predetermined radii; or collecting particles from one or more of the particle orbits.

28. A method of measuring the mass of a charged particle, comprising injecting a sample of charged particles into a chamber, performing the method of claim 27, wherein the step of detecting comprises detecting particles at one or more predetermined radii and the magnitude and/or shape of the radial balancing component is varied during movement of the charged particles so as to adjust the radii of the or each particle orbits, and calculating the mass of the particle(s) based on the variation of the radial balancing component and the predetermined radius.

29. A method of detecting a target particle, comprising injecting a sample of particles into a chamber and performing the method of claim 27, wherein the step of detecting comprises detecting particles at one or more predetermined radii and at least one of the predetermined radii corresponds to the known mass of the target particle, detection of charged particles at the at least one predetermined radii indicating the presence of the target particle.

30. A method of extracting a target particle from a mixed sample of particles, comprising injecting the mixed sample of particles into a chamber, and performing the method of claim 27, wherein the step of detecting comprises collecting particles from one or more of the particle orbits, to extract particles from a selected particle orbit having a radius determined based on the mass of the target particle.

31. A method of sorting a mixed sample of charged particles, comprising injecting the mixed sample of charged particles into a chamber and performing the method of claim 19.

* * * * *